US010766162B2

(12) United States Patent
Goto et al.

(10) Patent No.: US 10,766,162 B2
(45) Date of Patent: Sep. 8, 2020

(54) PORTABLE MACHINING DEVICE

(71) Applicant: MAKITA CORPORATION, Anjo-shi, Aichi (JP)

(72) Inventors: Hiromu Goto, Anjo (JP); Yuki Wada, Anjo (JP)

(73) Assignee: MAKITA CORPORATION, Anjo (JP)

( * ) Notice: Subject to any disclaimer, the term of this patent is extended or adjusted under 35 U.S.C. 154(b) by 97 days.

(21) Appl. No.: 15/921,108

(22) Filed: Mar. 14, 2018

(65) Prior Publication Data

US 2018/0290327 A1 Oct. 11, 2018

(30) Foreign Application Priority Data

Apr. 5, 2017 (JP) ..... 2017-075523

(51) Int. Cl.
*B25F 5/00* (2006.01)
*B27B 9/02* (2006.01)
*B25F 5/02* (2006.01)

(52) U.S. Cl.
CPC ..... *B27B 9/02* (2013.01); *B25F 5/008* (2013.01); *B25F 5/02* (2013.01)

(58) Field of Classification Search
CPC ..... B27B 9/02; B25F 5/008; B25F 5/02
USPC ..... 30/123
See application file for complete search history.

(56) References Cited

U.S. PATENT DOCUMENTS 8,935,857 B2 1/2015 Inayoshi
9,287,751 B2 3/2016 Naito et al.
9,364,906 B2 6/2016 Abe et al.
9,954,418 B2 * 4/2018 Kawakami ..... H02K 9/06
10,189,174 B2 * 1/2019 Brown ..... B25F 5/02
2008/0244910 A1 * 10/2008 Patel ..... B23D 45/122 30/123
2013/0333228 A1 * 12/2013 Ota ..... B23D 47/12 30/273
2015/0020391 A1 * 1/2015 Abe ..... B23D 47/12 30/388
2015/0026985 A1 1/2015 Yamaguchi et al.
2015/0266201 A1 * 9/2015 Nakashima ..... B23Q 9/00 30/374
2015/0328796 A1 11/2015 Okouchi et al.
2016/0176064 A1 6/2016 Okouchi et al.
2017/0021466 A1 * 1/2017 Hiroshima ..... B23Q 11/06
(Continued)

FOREIGN PATENT DOCUMENTS

DE 202013104555 U1 10/2013
EP 1892056 A1 2/2008
(Continued)

*Primary Examiner* — Andrea L Wellington
*Assistant Examiner* — Liang Dong
(74) *Attorney, Agent, or Firm* — Oliff PLC

(57) ABSTRACT

When the protruding length of a cutting blade 11 protruding below a lower surface of a base 2 of a portable machining device 1 is set to its maximum length, at least a part of a controller 31 for controlling an electric motor 12 is configured to be located behind a handle 14 in the front-to-rear direction. Furthermore, the controller 31 is disposed so as to be tilted in the left-to-right direction or in the up-to-down direction with respect to the cutting blade 11. Because of this configuration, the height of the handle 14 can be restricted and at the same time the controller 31 can be disposed in a compact manner.

14 Claims, 27 Drawing Sheets

(56) References Cited

U.S. PATENT DOCUMENTS

| | | | | |
|---|---|---|---|---|
| 2018/0021865 | A1 | 1/2018 | Yamaguchi et al. | |
| 2019/0131899 | A1* | 5/2019 | Kuragano ..... | H02K 11/0094 |

FOREIGN PATENT DOCUMENTS

| | | | |
|---|---|---|---|
| EP | 2638995 | A1 | 9/2013 |
| JP | 2011-183466 | A | 9/2011 |
| JP | 2013-193133 | A | 9/2013 |
| JP | 2014-4723 | A | 1/2014 |
| JP | 2014-79873 | A | 5/2014 |
| JP | 2014-148015 | A | 8/2014 |
| JP | 2015-20257 | A | 2/2015 |
| JP | 2015-112652 | A | 6/2015 |
| JP | 2015-178226 | A | 10/2015 |
| JP | 2017-24115 | A | 2/2017 |

* cited by examiner

PORTABLE MACHINING DEVICE

CROSS-REFERENCE

This application claims priority to Japanese patent application serial number 2017-075523, filed on Apr. 5, 2017, the contents of which are herein incorporated by reference in their entirety.

TECHNICAL FIELD

The present disclosure generally relates to a portable machining device and/or a portable machining tool such as, for example, a portable cutting device used for cutting a material to be cut (workpiece) such as wooden material, etc.

BACKGROUND ART

A conventional portable machining device generally includes, for example, a base that contacts an upper surface of the workpiece, as well as a machining device main body that is supported on an upper surface side of the base so as to be movable in an up-to-down direction. The machining device generally includes an electric motor, as well as a cutting blade that can rotate via the driving force of the electric motor. By moving the machining device main body in the up-to-down direction with respect to the base, the machining device can be positioned between a cutting position in which the cutting blade protrudes below a lower surface of the base and a retreat position in which the cutting blade retreats in the upward direction with respect to the lower surface of the base. With the rotation of the cutting blade that protrudes below the lower surface of the base and the movement of the machining device with respect to the workpiece, a cutting task can be performed. A cutting blade cover that covers approximately the circumferential periphery of the cutting blade may be provided on the upper surface of the base. A lower portion of the cutting blade that protrudes below the cutting blade cover in the downward direction can cut into the workpiece. The upper periphery of the blade in the cutting position can be covered by the cutting blade cover, which prevents cutting dust from scattering around.

This type of the portable machining device generally includes a controller that controls the electric motor. The controller is electrically insulated such that a printed circuit board of the controller is housed in a case having a rectangular plate shape and a shallow bottom, and the interior of the case is resin molded. Various techniques for the arrangement of the controller have been provided in these types of prior art portable machining devices. For example, Japanese Laid-Open Patent Publication No. 2014-79873 discloses a technique in which the controller is housed in an erect manner in the up-to-down direction at the rear of the electric motor. Japanese Laid-Open Patent Publication No. 2015-178226 discloses another technique in which the controller is housed in a slanted manner at the rear of the electric motor. Furthermore, Japanese Laid-Open Patent Publication No. 2014-148015 discloses still another technique in which the controller is housed in a laid-down manner above the electric motor.

The above-described techniques, however, have several problems. In Japanese Laid-Open Patent Publication No. 2014-79873, for example, the controller is directed in the upward direction, which interferes with a handle operation. As a result of the controller orientation, the handle has to be accordingly arranged in the upward direction so as avoid interference with handle operation. Additionally, in Japanese Laid-Open Patent Publication No. 2015-178226, the controller obstructs movement of the controller in approaching an operation lever or the base disposed in the vicinity of the controller when the machining main body is moved in the up-to-down direction. Furthermore, in Japanese Laid-Open Patent Publication No. 2014-148015, the handle has to be arranged in the upward direction due to the depth of the controller. Because of these problems, a loss of operability, a loss of handle maneuverability; and/or an increasing size of the products have occurred.

Thus, as a result of the mentioned deficiencies in the art, there is a need in the art to house the controller in order to prevent increasing size of the device as well as to improve operability and handle maneuverability.

SUMMARY

In one exemplary embodiment of the present disclosure, a portable machining device includes a base with which a material to be cut is brought into contact, a machining device main body that is supported above an upper surface of the base, and a handle that is integrally formed with the machining device main body. Furthermore, the machining device main body includes a rotary cutting blade that is rotated by using an electric motor serving as a drive source, the cutting blade configured to be movable in the up-to-down direction so as to be able to protrude below a lower surface of the base such that the cutting blade can perform a cutting task by cutting into a material to be cut. Furthermore, when the protruding length of the cutting blade below the lower surface of the base is at the maximum possible length, a part of a controller for controlling the electric motor is configured to be located behind the handle of the device main body in the front-to-rear direction.

According to this embodiment, when the protruding length of the cutting blade below the lower surface of the base is at its maximum, the controller is disposed behind the handle such that the entirety of the controller is not positioned so as to coincide with the entirety of the handle in the front-to-rear direction. Because of this controller arrangement, the operation of maneuverability of the handle is improved.

In another exemplary embodiment of the disclosure, the machining device main body is supported so as to be swung in the up-to-down direction via a swing fulcrum that is disposed behind the center of rotation of the cutting blade. When the protruding length of the cutting blade protruding below the lower surface of the base is at its the maximum, the controller is tilted so as to be extending upward from the front to the rear as seen from a side view. Furthermore, a part of the controller is located behind the swing fulcrum in the front-to-rear direction.

According to this embodiment, in the machining device in which the machining device main body is supported so as to be swung in the up-to-down direction via the swing fulcrum located behind the rotation center of the cutting blade, a space for housing the controller can be minimized in the front-to-rear direction, with the controller extending upward as described above. Furthermore, interference of the controller with respect to the base can be avoided, and at the same time, an upper moving end of the machining device main body can be positioned further upwards.

In another exemplary embodiment of the disclosure, a holding area for inserting a user's hand to hold the handle is arranged around the handle. Furthermore, a front portion of the controller is configured to overlap with the holding area in the front-to-rear direction, and a rear portion of the controller is also configured to be overlap with the holding area in the up-to-down direction.

According to this embodiment, a necessary and sufficient holding area for the user to hold the handle can be obtained and at the same time the controller can be disposed in a compact manner.

In another exemplary embodiment of the disclosure, the machining device main body is supported so as to be tiltable with the base in the left-to-right direction. Furthermore, when the machining device main body is situated at a right angle, the controller is configured to be tilted so as to be displaced in a direction approaching the cutting blade extending from the lower to the upper direction as seen from a rear view.

According to this embodiment, a space for housing the controller can be minimized in the up-to-down direction. Furthermore, interference of the controller with respect to the base can be avoided, and at the same time, the machining device main body can be tilted in the left-to-right direction at a larger angle.

In another exemplary embodiment of the disclosure, a battery pack is attachable to the machining device main body as a power source. Furthermore, when the protruding length of the cutting blade protruding below the lower surface of the base is at its maximum, the battery pack is configured to be disposed behind the electric motor in the front-to-rear direction and below the holding area of the handle in the up-to-down direction.

According to this embodiment, since the battery pack is disposed below the holding area of the handle, the battery pack does not interfere with holding of the handle.

In another exemplary embodiment of the disclosure, a portable machining device includes a base with which a material to be cut is brought into contact, and also includes a machining device main body that is supported above an upper surface of the base so as to be swung in the up-to-down direction via a swing fulcrum. Furthermore, the machining device main body includes a rotary cutting blade that is rotated by using an electric motor as a drive source, wherein the cutting blade is configured to be movable in the up-to-down direction to protrude below a lower surface of the base such that the cutting blade can perform a cutting task by cutting into a material to be cut. Furthermore, the controller for controlling the electric motor is disposed on a side of the swing fulcrum with respect to the electric motor in the front-to-rear direction.

According to this embodiment, the controller is disposed between the electric motor and the swing fulcrum in the front-to-rear direction in a compact manner. In the machining device in which the swing fulcrum is disposed on a front side of the electric motor, the controller is disposed in front of the electric motor. In contrast to this configuration, in the machining device in which the swing fulcrum is disposed on a rear side of the electric motor, the controller is disposed behind the electric motor.

DETAILED DESCRIPTION

The detailed description set forth below, when considered with the appended drawings, is intended to be a description of exemplary embodiments of the present invention and is not intended to be restrictive and/or to represent the only embodiments in which the present invention can be practiced. The term "exemplary" used throughout this description means "serving as an example, instance, or illustration," and should not necessarily be construed as preferred or advantageous over other exemplary embodiments. The detailed description includes specific details for the purpose of providing a thorough understanding of the exemplary embodiments of the invention. It will be apparent to those skilled in the art that the exemplary embodiments of the invention may be practiced without these specific details. In some instances, these specific details refer to well-known structures, components and/or devices that are shown in block diagram form in order to avoid obscuring significant aspects of the exemplary embodiments presented herein.

Representative, non-limiting embodiments according to the present disclosure will be described with reference to FIGS. 1 to 10. In the embodiments, a cutting device such as a circular saw, which a user holds and operates to perform a cutting task, is exemplified as a portable machining device 1. In the following embodiments, the forward and rearward directions of members and configurations may be described relative to the direction in which a cutting task of the portable machining device 1 is performed. In particular, the direction in which the portable machining device 1 proceeds to cut a workpiece is referred to as the front side. Thus, the user may be situated on the rear side of the portable machining device 1. Furthermore, the leftward and rightward directions of the members may be described relative to the user's position at the rear of the device, facing the device.

Figure 1:
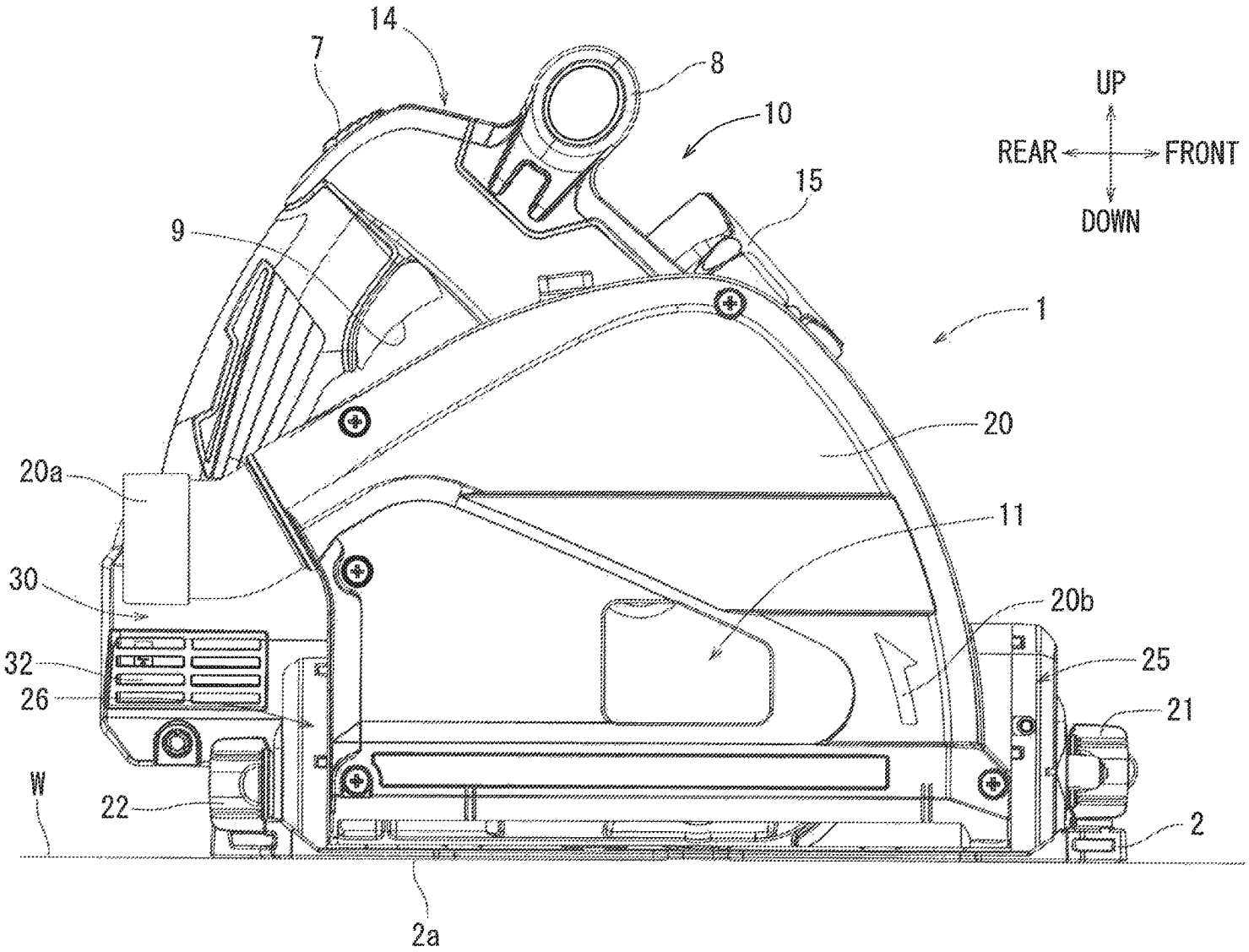
FIG. 1 is a right side view of a portable machining device according to an exemplary embodiment (first embodiment) of the present disclosure, showing a state where a portable machining device main body is situated at an upper standby position
Figure 2:
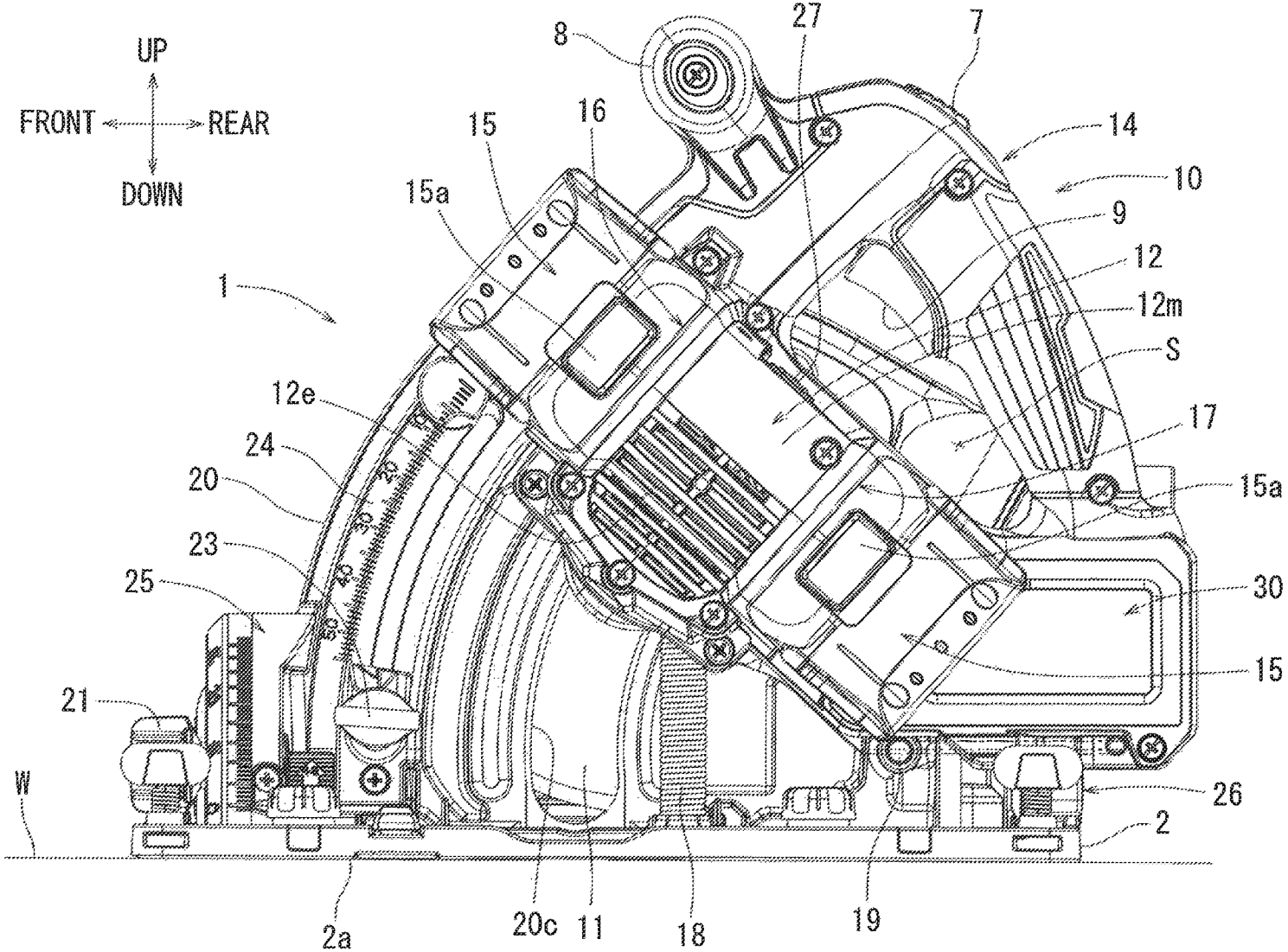
FIG. 2 is a left side view of the portable machining device according to the exemplary embodiment (first embodiment), showing a state where the portable machining device main body is moved to an upper end position.
Figure 3:
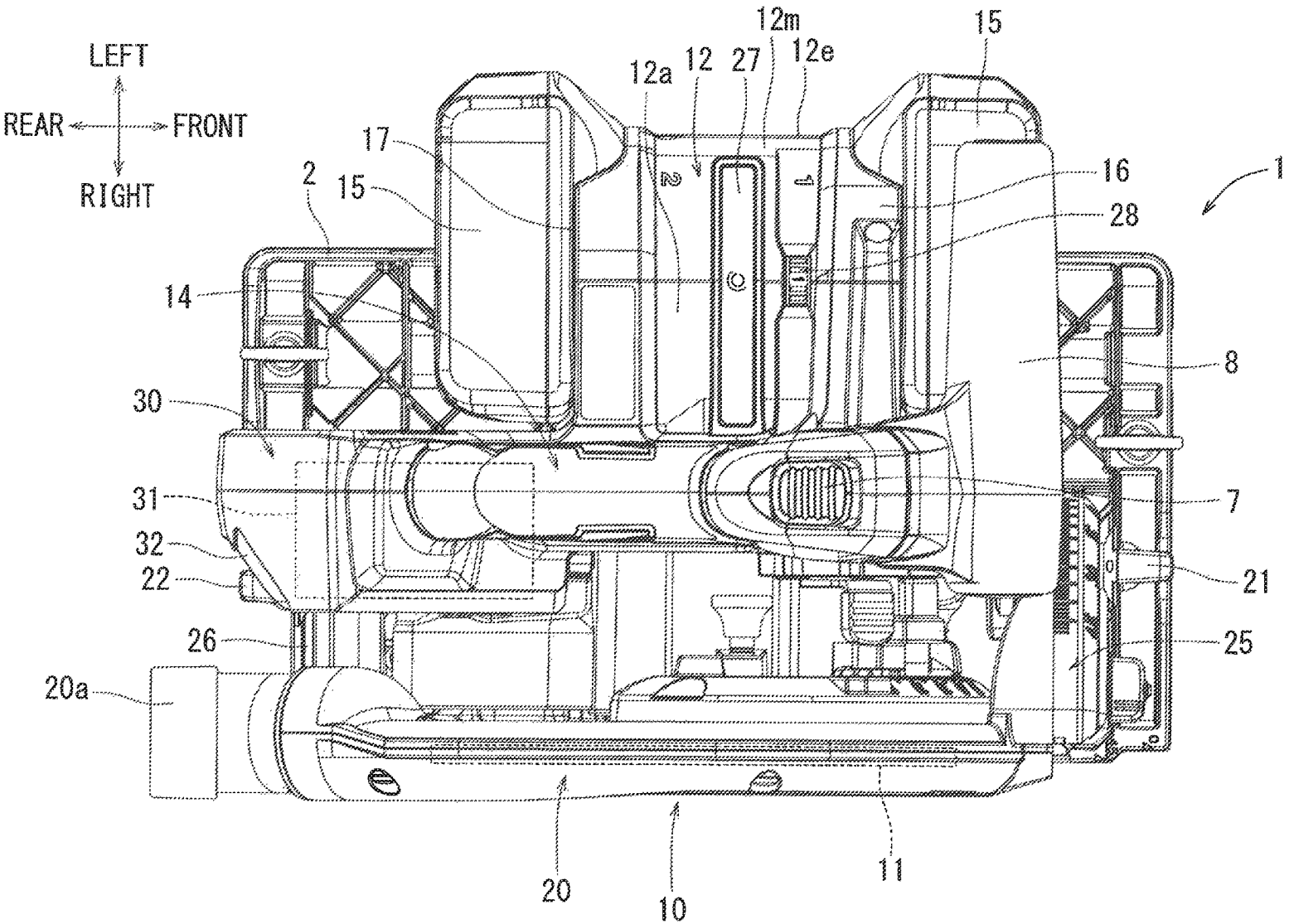
FIG. 3 is an overall plan view of the portable machining device according to the exemplary embodiment (first embodiment).

As shown in FIGS. 1 to 3, the portable machining device 1 may be referred to as a so-called plunge circular saw, which generally includes a base 2 that is brought into contact with an upper surface of a workpiece W as well as a machining device main body 10 that is supported on an upper surface side of the base 2. The base 2 may have an approximately rectangular flat-plate shape. A lower surface of the base 2 may be a contact surface 2*a* that is brought into contact with the workpiece W. A cutting blade cover 20 may be supported on an upper surface side of the base 2. A front support portion 25 and a rear support portion 26 may be provided on the upper surface of the base 2 at a forward position and a rearward position, respectively. The front support portion 25 and the rear support portion 26 may be provided parallel to each other in an erected manner. The cutting blade cover 20 may be supported so as to be tiltable in the left-to-right direction via the front support portion 25 and the rear support portion 26.

Figure 4:
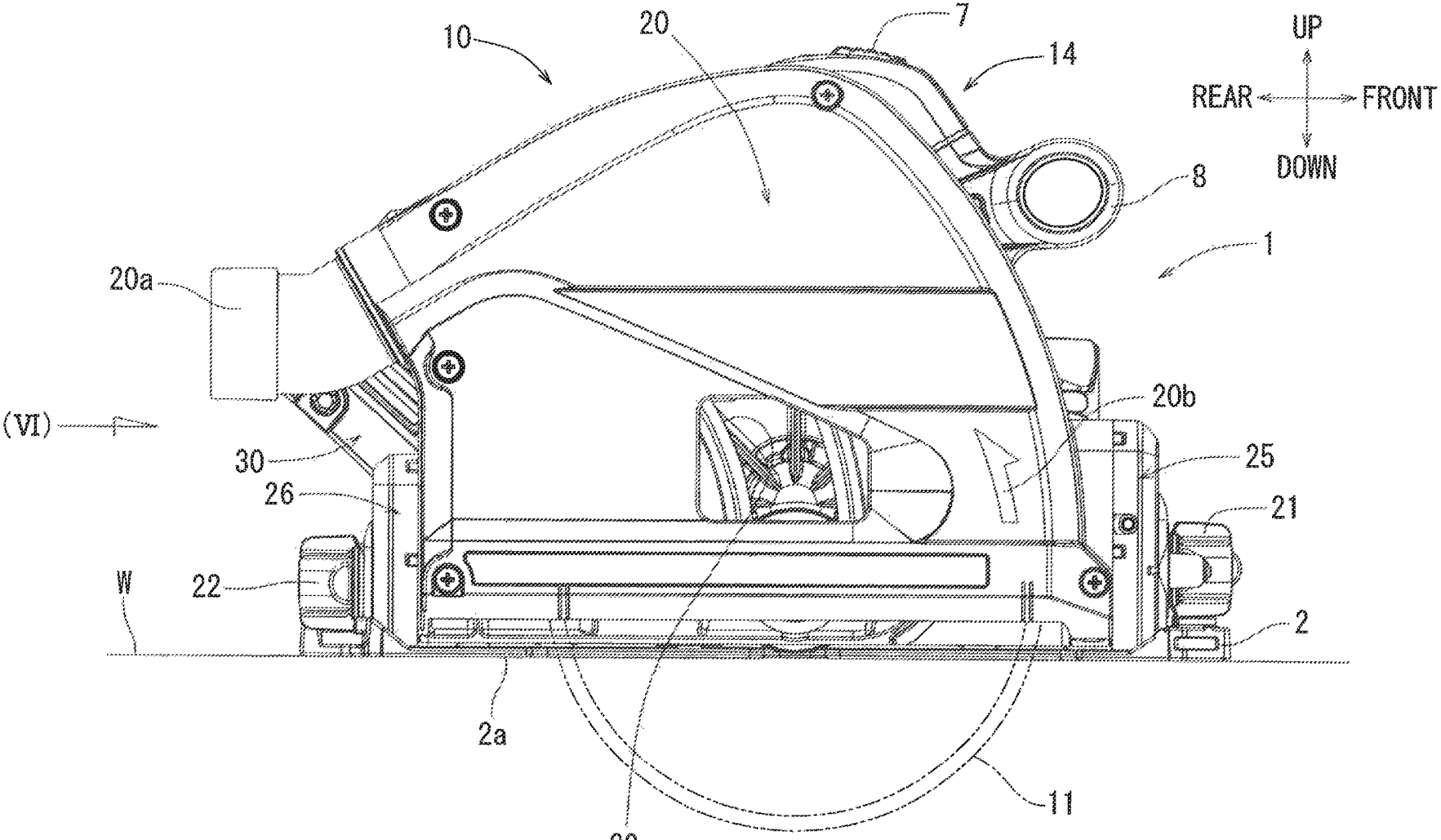
FIG. 4 is a right side view of the portable machining device according to the exemplary embodiment (first embodiment), showing a state where the portable machining device main body is moved to a lower end position.
Figure 5:
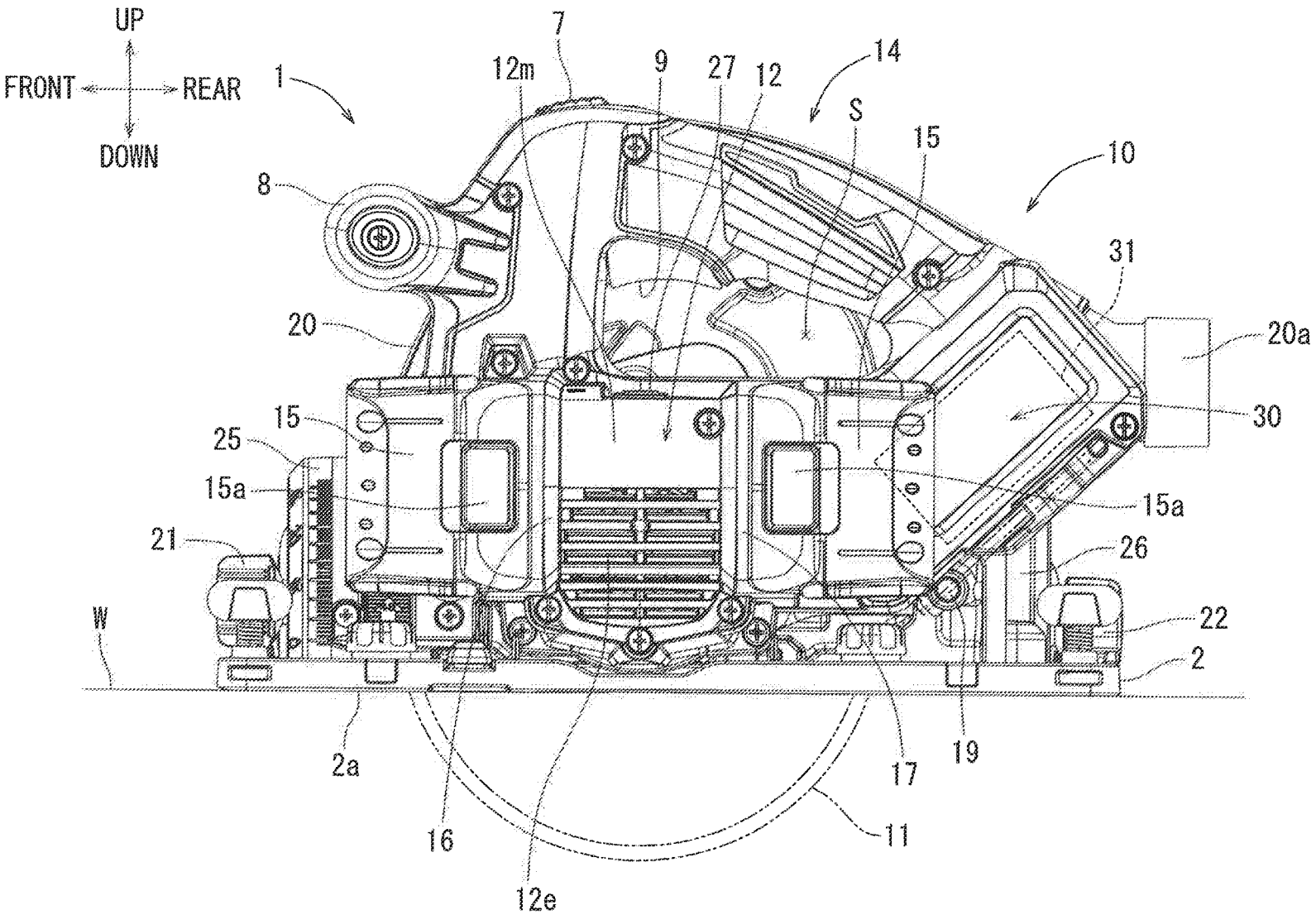
FIG. 5 is a left side view of the portable machining device according to the exemplary embodiment (first embodiment), showing a state where the portable machining device main body is moved to a lower end position
Figure 6:
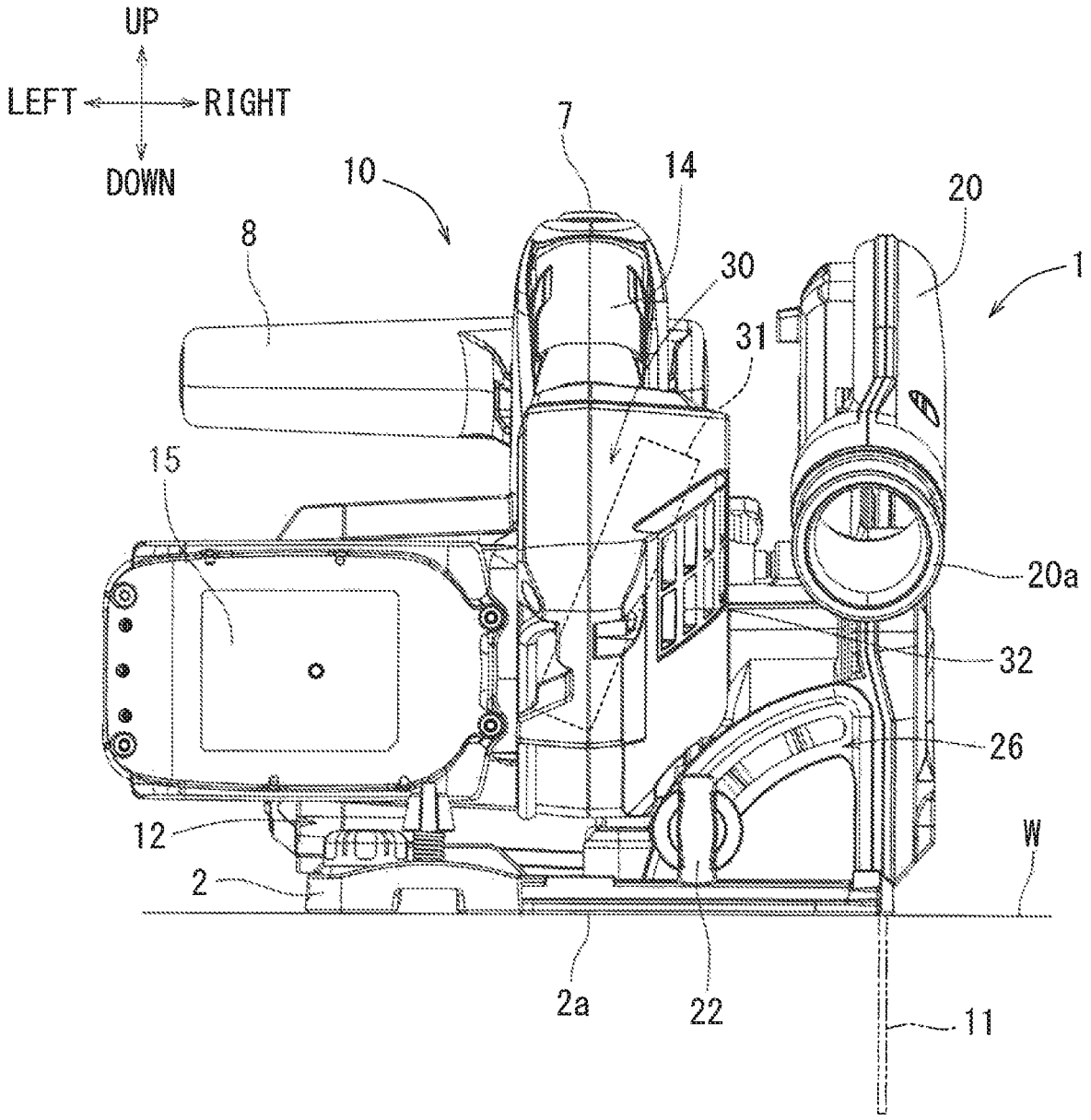
FIG. 6 is a rear view of the portable machining device according to the exemplary embodiment (first embodiment) as seen from (VI) of FIG. 4.

As shown in FIGS. 2 and 3, a rear portion of the machining device main body 10 may be supported on a left side of the cutting blade cover 20 via a main body support shaft 19 about which the machining device main body 10 can be swung in the up-to-down direction. The main body support shaft 19 may be disposed to the rear of the center of rotation, spindle 3 (see FIG. 7), of the cutting blade 11. Thus, the cutting blade 11 may be largely moved in the up-to-down direction within the cutting blade cover 20. The machining device main body 10 may be biased to swing in an upward direction by a compression spring 18 that is interposed between the machining device main body 10 and the base 2. As shown in FIG. 2, the machining device main body 10 may be held at an upper end position (standby position) by the biasing force of the compression spring 18. A lower portion of the cutting blade 11 may protrude below the contact surface 2*a* of the base 2 in the downward direction when the machining device main body 10 is swung about the main body support shaft 19 in the downward direction against the biasing force of the compression spring 18. FIGS. 4 to 6 show a state upon swinging the machining device main body 10 in the downward direction, where the protruding length of the cutting blade 11 below the contact surface 2*a* of the base 2 reaches its maximum (where the machining device main body 10 reaches a lower end position). By moving the portable machining device 1 in the forward direction while this lowermost protruding state of the cutting blade 11 is being held, the cutting blade 11 can cut into the workpiece W from the blade's front end and a cutting task can be performed. Instead of moving in the forward direction, if the machining device main body 10 is swung in the downward direction while the cutting blade 11 rotates, driven by the driving force of electric motor 12, the lower portion of the rotating cutting blade 11 may protrude below the contact surface 2*a* of the base 2 so as to enter downwards into the workpiece W when performing a cut, where said cut is referred to as a plunge cut.

Figure 10:
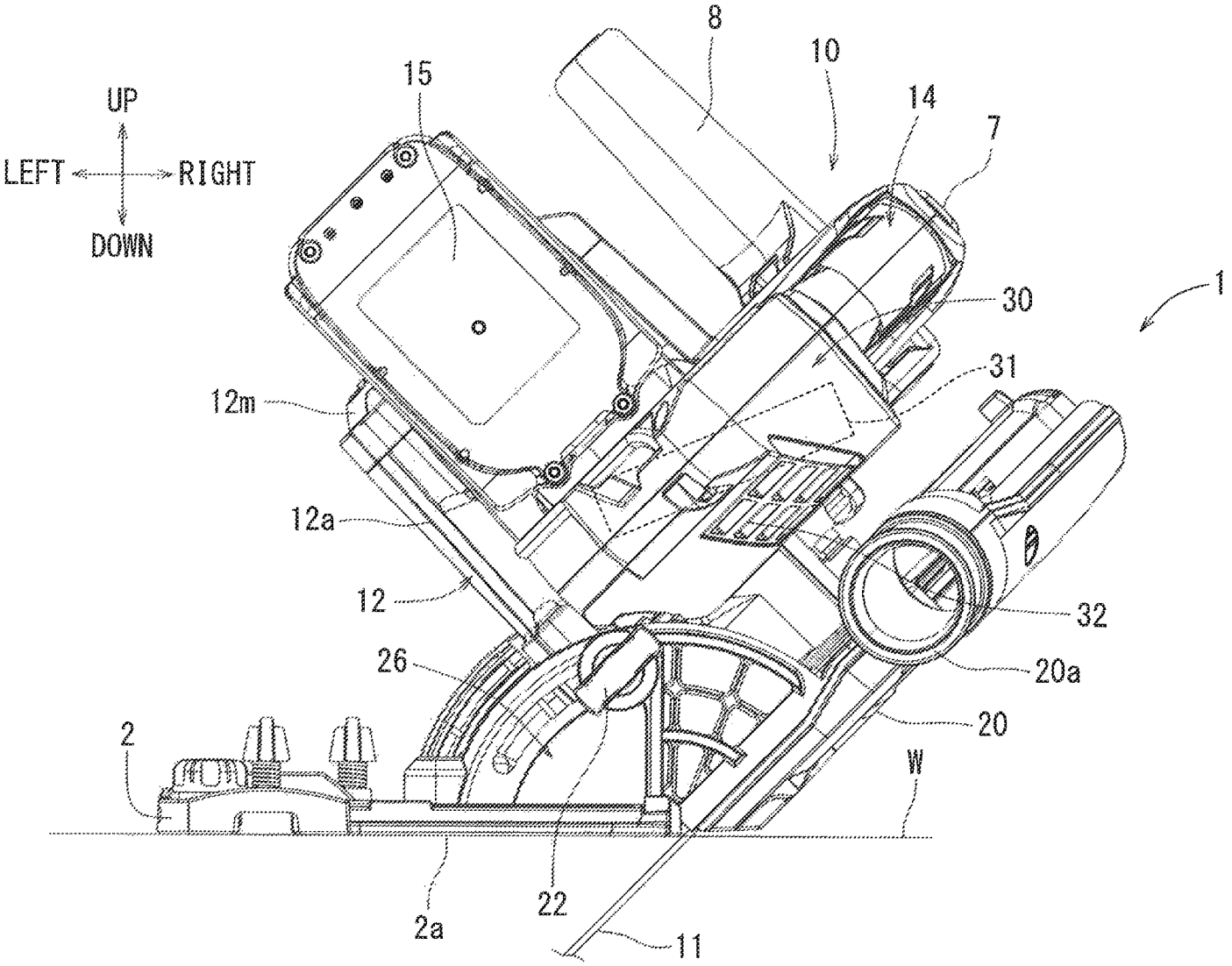
FIG. 10 is a rear side view of the portable machining device according to the exemplary embodiment (first embodiment), showing a state where the portable machining device main body is moved to the lower end position and tilted such that a top of the portable machining device main body is moved in a rightward direction.

The machining device main body 10 may be supported by the cutting blade cover 20 that in turn can be maneuvered to tilt in the left-to-right direction via the front support portion 25 and the rear support portion 26. Because of this configuration, the cutting blade 11 within the cutting blade cover 20 can also consequently be tilted with respect to the base 2 in the left-to-right direction. FIG. 10 shows a state where the machining device main body 10 is tilted in the rightward direction by approximately 45°. By tilting the cutting blade 11 in the leftward/rightward direction, the portable machining device 1 can be used to perform an oblique cut into the workpiece W A tilt angle of the cutting blade cover 20, and in turn that of the cutting blade 11 within the cutting blade cover 20, may be indicated and measured by lines demarcating angles on an angle scale provided on the front support portion 25 (see FIG. 2). A tilt position of the cutting blade cover 20, and by consequence that of the cutting blade 11, with respect to the base 2 can be adjusted as desired to a particular angle by fastening the fixing screws 21, 22.

The cutting blade cover 20 may cover the upper region of the cutting blade 11 above contact surface 2*a*, which prevents cutting dust from scattering. A dust collection port 20*a* used for connecting a dust collection hose or a dust collection box may be provided at the rear of the cutting blade cover 20. As a result, cutting dust blown out in the proximity of a cutting position (cut-out position by the cutting blade 11), where said dust is generated by rotation of the cutting blade 11 and contact with a workpiece, may flow in the rearward direction, and consequently said cutting dust may be collected through the dust collection port 20*a*. As shown in FIGS. 1 and 4, an arrow 20*b* showing the rotation direction of the cutting blade 11 may be indicated on the right surface side of the cutting blade cover 20.

Figure 8:
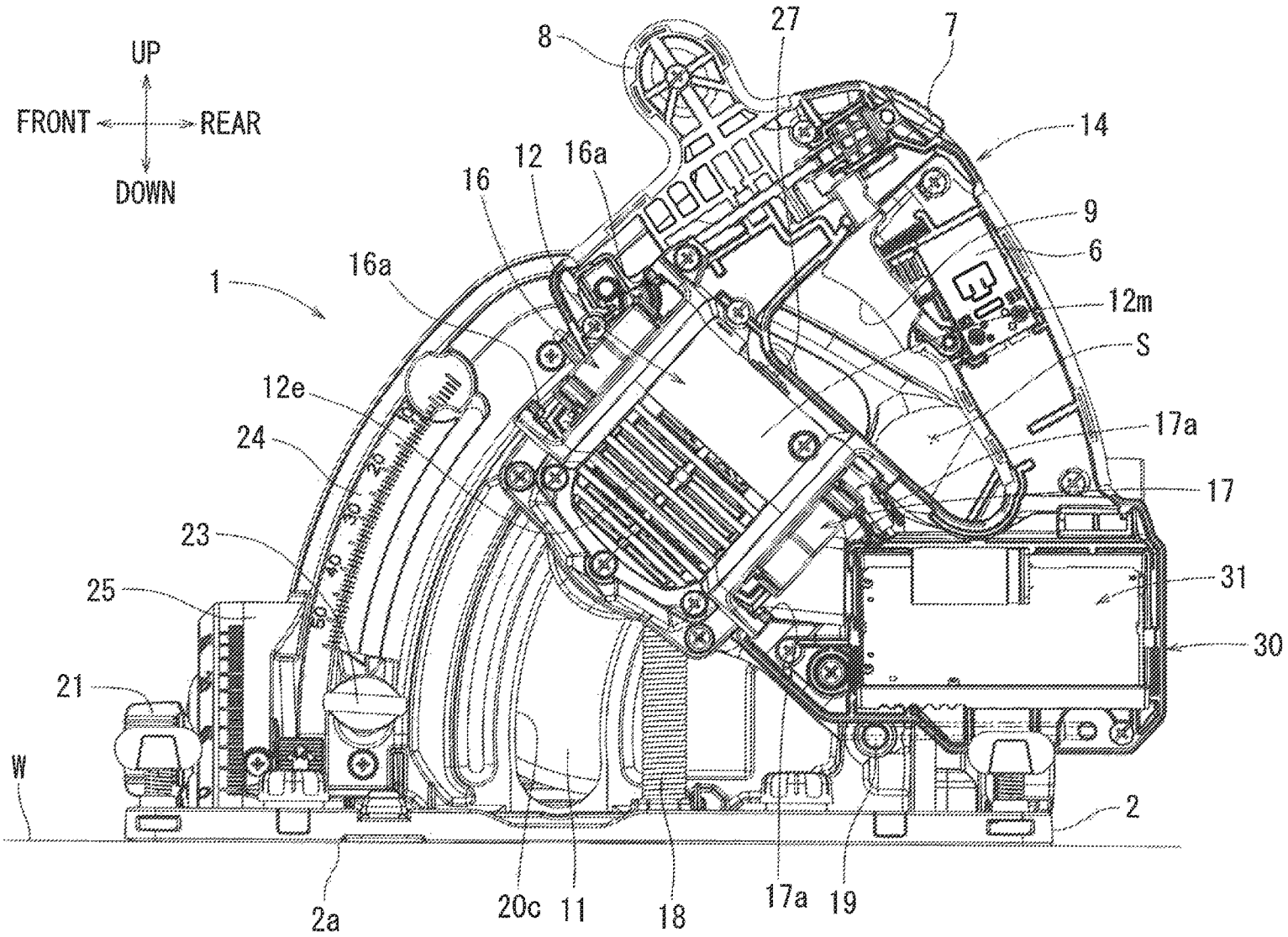
FIG. 8 is a left side view of the portable machining device according to the exemplary embodiment (first embodiment), showing a state where the portable machining device main body is moved to the upper end position. This figure shows a right half-split housing of a handle from which a left half-split housing of the handle is removed.

A swing position (swing angle) of the machining device main body 10 can be fixed to a lower end position or an arbitrary position during a swing operation so as to not be further movable in the downward direction by fastening a fixing screw 23 provided on the left surface side of the cutting blade cover 20 as shown in FIGS. 2 and 8. By adjusting the swing position of the machining device main body 10 and fixing the swing position in the up-to-down direction by using the fastening screw 23, the protruding length of the cutting blade 11 below the contact surface 2*a* can thereby be fixed to an arbitrary and/or a predetermined length. Because of this adjustment, the cutting depth of the cutting blade 11 with respect to the workpiece W can be adjusted and fixed to an arbitrary and/or a predetermined length. As shown in FIGS. 2 and 8, a cutting depth scale 24 for indicating the cutting depth of the cutting blade 11 may be provided on the left surface side of the cutting blade cover 20.

Figure 7:
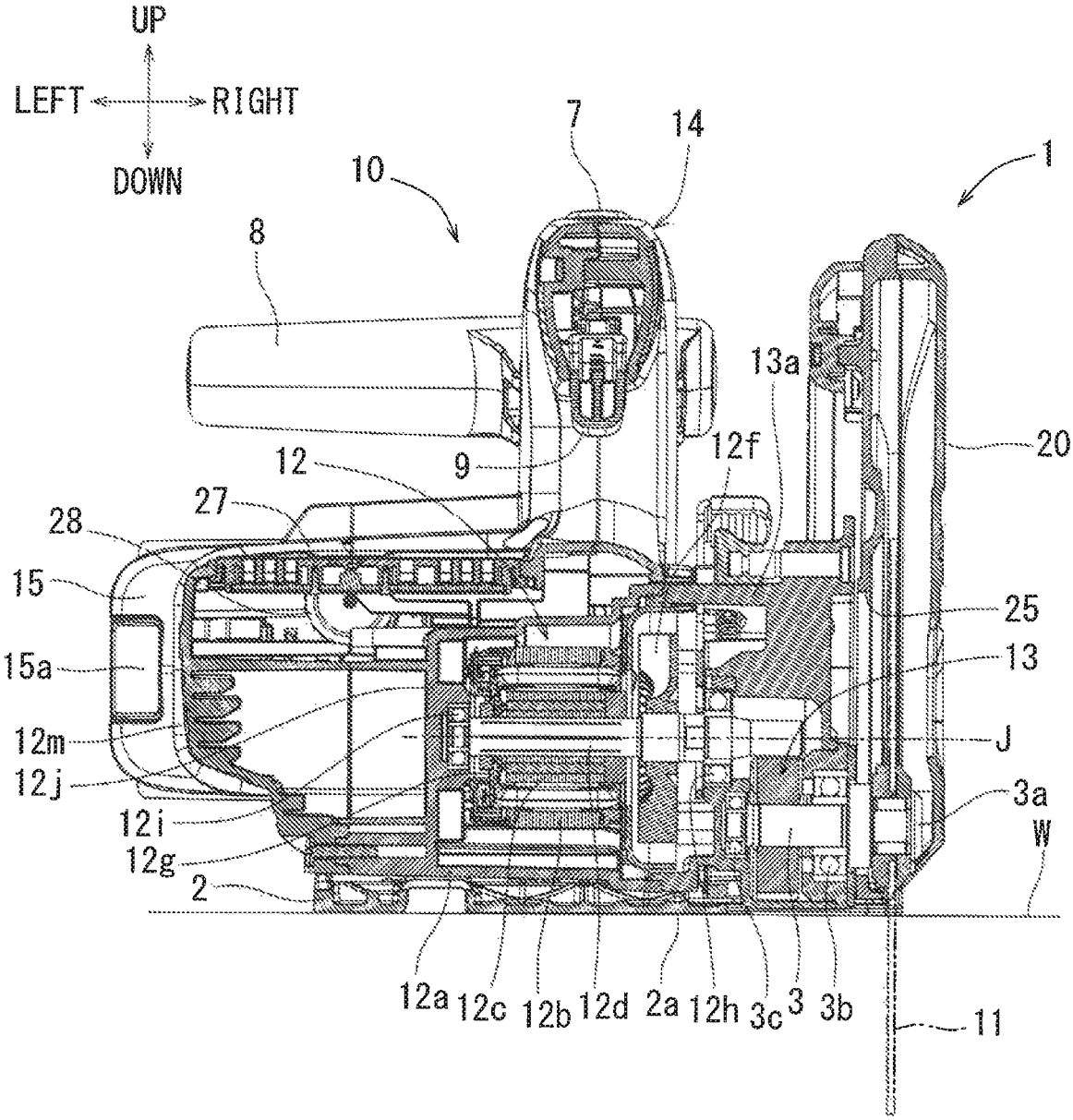
FIG. 7 is a longitudinal cross-sectional view of the portable machining device according to the exemplary embodiment (first embodiment), showing a vertical plane passing a rotation center of a cutting blade.

As shown in FIG. 7, the machining device main body 10 may be provided with the electric motor 12 that serves as the driving source for and rotates the cutting blade 11. The machining device main body 10 may also be provided with a reduction gear portion 13 that houses a reduction gear train for decreasing rotation output of the electric motor 12 in a gear case 13*a*, and a handle 14 that a user holds. The electric motor 12 may be connected to the left side of the reduction gear portion 13.

A DC brushless motor that is powered by a battery pack 15 (DC power source) serving as a power source can be used as the electric motor 12. The electric motor 12 may be provided with a stator 12*b* that is fixed to a motor case 12*a*, as well as a rotor 12*c* that is rotatably supported on an inner circumference of the stator 12*b*. A sensor PCB 12*g* including an electromagnetic sensor for detecting a rotation position of the rotor 12*c* may be attached to the rear surface (left surface) of the stator 12*b* in a direction of a motor axis J. A motor shaft 12*d* that is joined to the rotor 12*c* may be rotatably supported around the motor axis J via a right bearing 12*h* and a left bearing 12*i*. The right bearing 12*h* may be held in the gear case 13*a* and the left bearing 12*i* may be held in an intermediate partition wall 12*j* of the motor case 12*a*.

Figure 9:
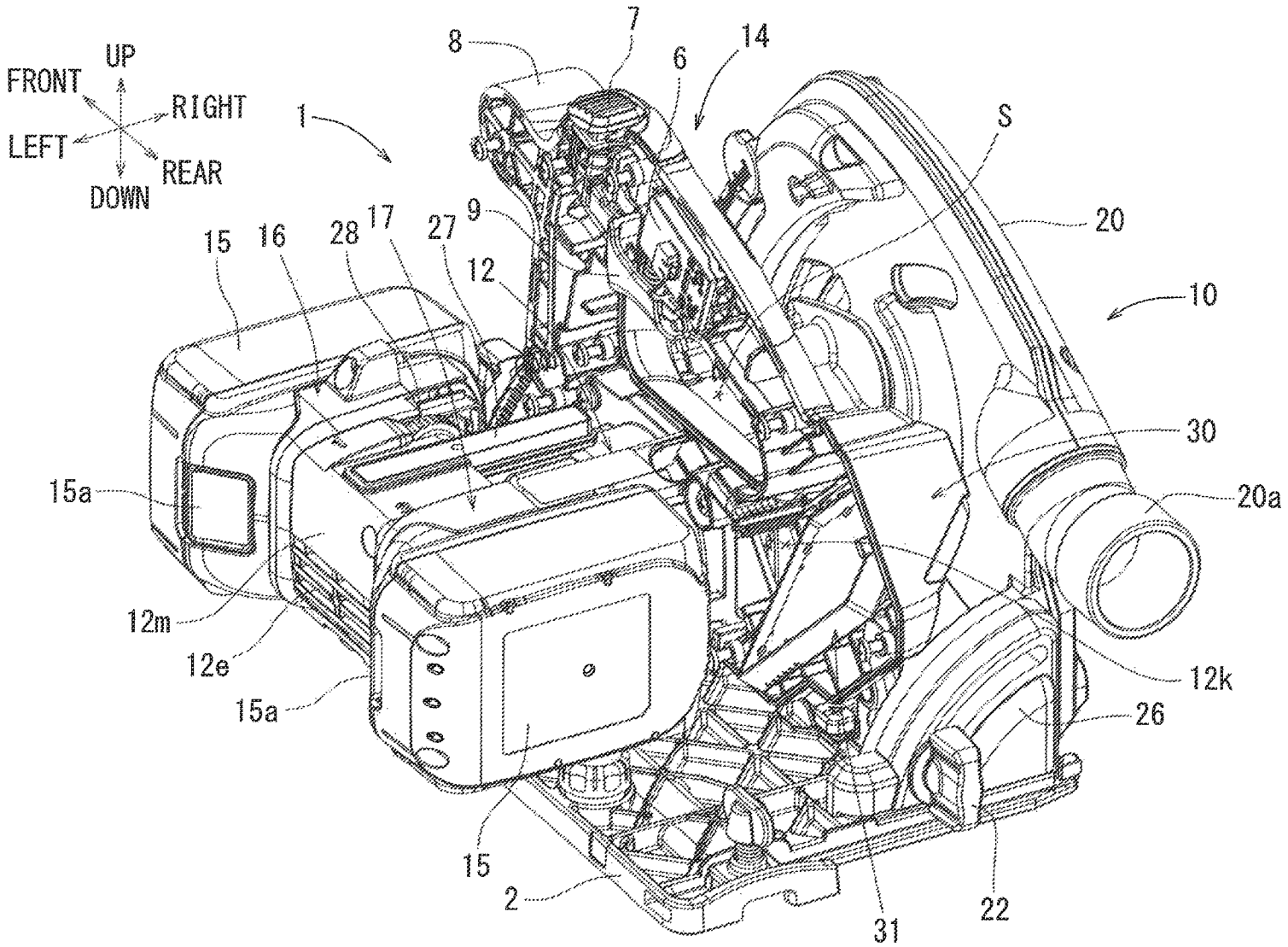
FIG. 9 is a perspective view of the portable machining device according to the exemplary embodiment (first embodiment) seen obliquely from the rear left, showing right half-split housings of the handle and a controller housing from which the left half-split housings thereof are removed.

A cooling fan 12*f* may be attached to the motor shaft 12*d*. As shown in FIGS. 2, 5 and 8, a plurality of intake holes 12*e* may be provided on the left side of the motor case 12*a*. When the electric motor 12 is driven, the cooling fan 12*f* attached to the motor shaft 12*d* may rotate synchronously with the motor shaft 12*d*. Due to the rotation of the cooling fan 12*f*, outside air may be introduced into the motor case 12*a* via the intake holes 12*e*. Outside air which flows into the motor case 12*a* may flow in the rightward direction (in the direction of the motor axis J toward the cutting blade 11), cooling the stator 12*b*, the rotor 12*c* and the sensor PCB 12*g*, etc. A ventilation hole 12*k* may be provided on the motor case 12*a* on the lateral side of the cooling fan 12*f* (at the front/rear side of the fan) as shown in FIGS. 7 and 9. Outside air (motor cooling air) that has cooled the interior of the motor case 12*a* may flow into a controller housing 30 via the ventilation hole 12*k*. Outside air which flows into the controller housing 30 may be used for cooling the controller 31, which will be discussed in detail infra.

Rotation output of the electric motor 12 may be decreased through the reduction gear portion 13 and then transferred to the spindle 3. The spindle 3 may protrude into the interior of the cutting blade cover 20 through an arc-shaped insertion groove hole 20*c* provided on the left side of the cutting blade cover 20. Furthermore, a tip end of the spindle 3 protruding into the interior of the cutting blade cover 20 may be attached to the circular cutting blade 11. The center of rotation of the cutting blade 11 may be fixed by use of a cutting blade fixing screw 3*a* that can be firmly fastened and fixed to the tip end surface of the spindle 3. The spindle 3 may be rotatably supported by the gear case 13*a* via a right bearing 3*b* and a left bearing 3*c*.

As shown in FIG. 9, a battery attachment portion 16 may be provided on the front side of the motor case 12*a*. Similarly, a battery attachment portion 17 may be provided on the rear side of the motor case 12*a*. The battery attachment portions 16 and 17 may be used for attaching battery packs 15 at the front or back of the motor case 12*a*, respectively. FIG. 8 shows a state where the battery packs 15 are removed from the battery attachment portions 16 and 17. Each of the front battery attachment portion 16 and the rear battery attachment portion 17 may be configured such that a slide-attachment-type battery pack 15 can be attached thereto. In more detail, the front battery attachment portion 16 may be provided with a pair of upper and lower rails 16*a*. Furthermore, positive and negative battery terminals may be arranged between the pair of upper and lower rails 16*a*. Similarly, the rear battery attachment portion 17 may be provided with a pair of upper and lower rails 17*a*, and positive and negative battery terminals may be arranged between the pair of upper and lower rails 17*a*. The battery packs 15 may be attached by being slid into each of the front and rear battery attachment portions 16 and 17, respectively, in the rightward direction. On the contrary, the battery pack 15 may be detached from each of the front and rear battery attachment portions 16 and 17 by being slid in the leftward direction while a removal button 15*a* provided on the left end of the battery pack 15 is concomitantly pressed.

A lithium ion battery may be used as the battery pack 15 in which a plurality of lithium ion battery cells are housed in a battery case having an approximately hexahedral shape. The battery pack 15 may be highly versatile such that it can be attached to other electric power tools, other than the portable machining device 1. By sliding the hexahedrally-shaped battery pack 15 in the direction of the motor axis J toward and away from the cutting blade 11, the battery pack 15 can be attached to and removed from each of the battery attachment portions 16 and 17, respectively. When the battery packs 15 are removed from the battery attachment portions 16 and 17, they can be recharged by a dedicated battery charger, such that they can be repeatedly used.

As shown in FIGS. 3 and 7, a residual capacity display portion 27 for showing residual capacity of the battery backs 15 and a variable speed dial 28 for finely adjusting a rotational speed of the electric motor 12 may be provided on the upper surface of the motor case 12*a*.

As shown in FIG. 9, a controller housing 30 may be provided on the right side of the rear battery attachment portion 17 at the rear of the electric motor 12. The controller housing 30 may have a box shape extending from the rear of the motor case 12*a* in the rearward direction. As shown in FIG. 2, the controller housing 30 may be configured such that when the machining device main body 10 is positioned at its upper end position, the controller housing 30 extends approximately horizontally from the rear of the motor case 12*a* in the rearward direction along and to the rear of the upper rearmost surface of the base 2. Because of this configuration, as shown in FIG. 5, when the machining device main body 10 is moved to its lower end position, the rear side of the controller housing 30 may be directed counterclockwise upward and forward in a tilting manner in the upward direction. A controller 31 for mainly controlling the electric motor 12 may be housed in the controller housing 30. In the present embodiment, features as to the position of the controller 31 in the controller housing 30 are devised, which will be discussed in more detail infra.

The handle 14 that the user holds may have a loop shape straddling the upper portion of the motor case 12*a* of the electric motor 12 as well as the rear upper surface of the controller housing 30. A front portion of the handle 14 may be joined to the upper surface of the motor case 12*a* and a rear portion of the handle 14 may be joined to the rear upper surface of the controller housing 30. An inner circumference of the handle 14 having the loop shape may have a sufficient space (holding area S) in a manner such that the user can insert their hand into the area so as to grip/hold the handle 14. A trigger-type switch lever 9 which may be pulled inwards by a user's fingertips may be provided on the underside of the inner periphery of the handle 14. As shown in FIG. 8, a main switch 6 may be housed in the handle 14 at the rear of the switch lever 9 in a pulling direction of the switch lever 9. When the switch lever 9 is pulled, the main switch 6 may be switched on, starting to drive electric motor 12. When the electric motor runs, the cutting blade 11 may begin to rotate.

A front grip 8 may be provided at the front portion of the handle 14. As shown in FIGS. 3, 6 and 7, the front grip 8 may extend from the front portion of the handle 14 in the leftward direction. The user can easily move and operate the portable machining device 1 in a more stable manner by holding the handle 14 with one hand and the front grip 8 with another hand. A lock off lever 7 may be provided on the upper surface of the handle 4. When the lock off lever 7 is not in a forward position, the switch lever 9 may be locked in an off position so as to not be able to be pulled. In contrast, when the lock off lever 7 is slid to the forward position with, for example, a thumb of the user's hand that holds the handle 14, the switch lever 9 may be able to be pulled inward by the user's fingertips.

The controller 31 may have a rectangular plate shape and may house a control circuit board in a case having a shallow bottom. The interior of the case may be resin molded. The controller 31 may include a control circuit for mainly controlling the electric motor 12 and a power supply circuit. In more detail, the control circuit may include a microprocessor that transmits a control signal based on positional information of the rotor 12*c* that is detected by the sensor PCB 12*g* of the electric motor 12. Furthermore, the controller 31 may also include a drive circuit composed of FETs that switches the current of the electric motor 12 based on the control signal received from the control circuit. Furthermore, the controller 31 may also include an auto-stop circuit that interrupts power supply to the electric motor 12 based on a detection result from the battery pack 15 in order to prevent over-discharging and over-current conditions.

As shown in FIGS. 8 and 9, the rectangular flat-shaped controller 31 may be housed in the controller housing 30 in a tiltable manner mainly in the left-to-right direction. As shown in FIG. 8, in the present embodiment (first embodiment), when the machining device main body 10 is moved to its upper end position, the controller 31 may be situated so as to be fixed approximately horizontal in the front-to-rear direction but tiltable in the left-to-right direction such that the top portion of the controller 31 may approach the side of the cutting blade 11 (in a direction in which the controller 31 is tilted toward the rightward direction from a right angle with regard to the base 2). Because of this configuration, as shown in FIG. 9, when the machining device main body 10 is moved to its lower end position, the controller 31 may be tilted in the front-to-rear direction as well as in the left-to-right direction.

Furthermore, when the machining device main body 10 is moved to its lower end position, the entirety of the controller 31 may be situated to be offset rearwards from a location where the handle 14 (the holding area S) extends in the front-to-rear direction. In this way, the controller 31 may be arranged to be tiltable in the front-to-rear direction as well as in the left-to-right direction and in the up-to-down-direction without interference. In other words, the controller 31 may be tilted in a compound manner. Because of this configuration, the height of the handle 14 may be restricted and at the same time sufficient holding space (holding capability) can be obtained.

Furthermore, the machining device main body 10 may be supported so as to be swung in the up-to-down direction about the main body support shaft 19 (swing fulcrum) that is located to the rear of the center of rotation of the cutting blade 11 (to the rear of the spindle 3). Furthermore, the controller 31 may be arranged to be offset in the rearward direction with respect to the main body support shaft 19. Because of this configuration, as shown in FIG. 5, when the protruding length of the cutting blade 11 protruding below the lower surface of the base 2 is at its maximum, the controller 31 may be tilted about the main body support shaft 19 so as to be displaced counterclockwise in the forward and upward direction as seen from the side view of FIG. 5. Because of this configuration, the space for housing the controller 31 (controller housing 30) can be made to be compact in the front-to-rear direction. Furthermore, while being compact, interference of the controller housing 30 or the controller 31 with respect to the base 2 is avoided, and also the machining device main body 10 is maneuverable to be swung to a larger angle in the upward or left-to-right direction to decrease the protruding length of the cutting blade 11 protruding below the lower surface of the base 2.

Furthermore, the holding area S for inserting the user's hand to hold the handle 14 may be arranged surrounding the handle 14 (mainly around the underside of the lower periphery of the handle 14). The controller 31 may be housed in the controller housing 30 in a tiltable manner such that the front portion of the controller 31 may overlap with the holding area S in the front-to-rear direction and the rear portion of the controller 31 may overlap with the holding area S in the up-to-down direction. Because of this configuration, a necessary and sufficient holding area S to hold the handle 14 (for obtaining a sufficient holding capability of the handle 14) can be obtained, while at the same time the controller 31 can be arranged in a compact and maneuverable manner.

The machining device main body 10 may be supported so as to be tiltable with respect to the base 2 via the front support portion 25 and the rear support portion 26. As shown in FIG. 6, when the machining device main body 10 is situated at a right angle position with respect to the base 2, the controller 31 may be placed in a tilted manner in the controller housing 30 so as to be displaced in a direction approaching the cutting blade 11 (in the rightward direction) from the down-to-up viewing direction as seen from the rear view of FIG. 6. Because of this arrangement of the controller 31, the controller housing 30 can be made to be compact in the left-to-right direction. Furthermore, as shown in FIG. 10, when the machining device main body 10 is tilted in the rightward direction, interference of the controller housing 30 with respect to the base 2 can be avoided and thus this compact configuration enables the machining device main body 10 to be tilted at a larger angle in the rightward direction.

Furthermore, as shown in FIG. 5, when the protruding length of the cutting blade 11 protruding below the lower surface of the base 2 is at its maximum, each of the battery packs 15 may be respectively disposed at the front and the rear, respectively, of the electric motor 12 below the holding area S of the handle 14. Because of this configuration, when the user holds the handle 14, the battery packs 15 do not interfere with the user's operation.

As shown in FIGS. 7 and 9, the interior of the controller housing 30 may be in fluid communication with the interior of the motor case 12*a* of the electric motor 12 through the ventilation hole 12*k* provided adjacent to the cooling tan 12*f*. Because of this configuration, the motor cooling air may flow into the interior of the controller housing 30 through the ventilation hole 12*k*. The motor cooling air passing through the ventilation hole 12*k* may be blown out to the controller 31, which can cool the controller 31. The motor cooling air that has cooled the controller 31 may be further discharged to the outside through an exhaust hole 32 provided on the right side of the controller housing 30, as shown in FIG. 6. In this way, the controller 31 in which heat generation sources such as switching elements are mounted can be efficiently cooled by use of sourcing the motor cooling air from the cooling fan 12*f*.

According to the portable machining device 1 of the present embodiment (first embodiment) as discussed above, the controller 31 having the rectangular flat-plate shape may be arranged at the rear of the electric motor 12 and at the same time to be offset in the rearward direction with respect to the holding area. S of the handle 14. Because of this configuration of the controller 31, sufficient holding area S (holding capability) can be obtained and at the same time the height of the handle 14 may be restricted.

Furthermore, the controller 31 may be housed in the controller housing 30 in a compound tilting manner so as to be tilted concomitantly in the front-to-rear direction, in the up-to-down direction and in the left-to-right direction. Because of this configuration of the controller 31, the controller housing 30 can be made to be compact and as a result interference of the controller housing 30 with respect to the base 2 can be avoided, and thus the machining device main body 10 is able to be swung at a greater range of angles in the up-to-down left-to-right directions.

Figure 11:
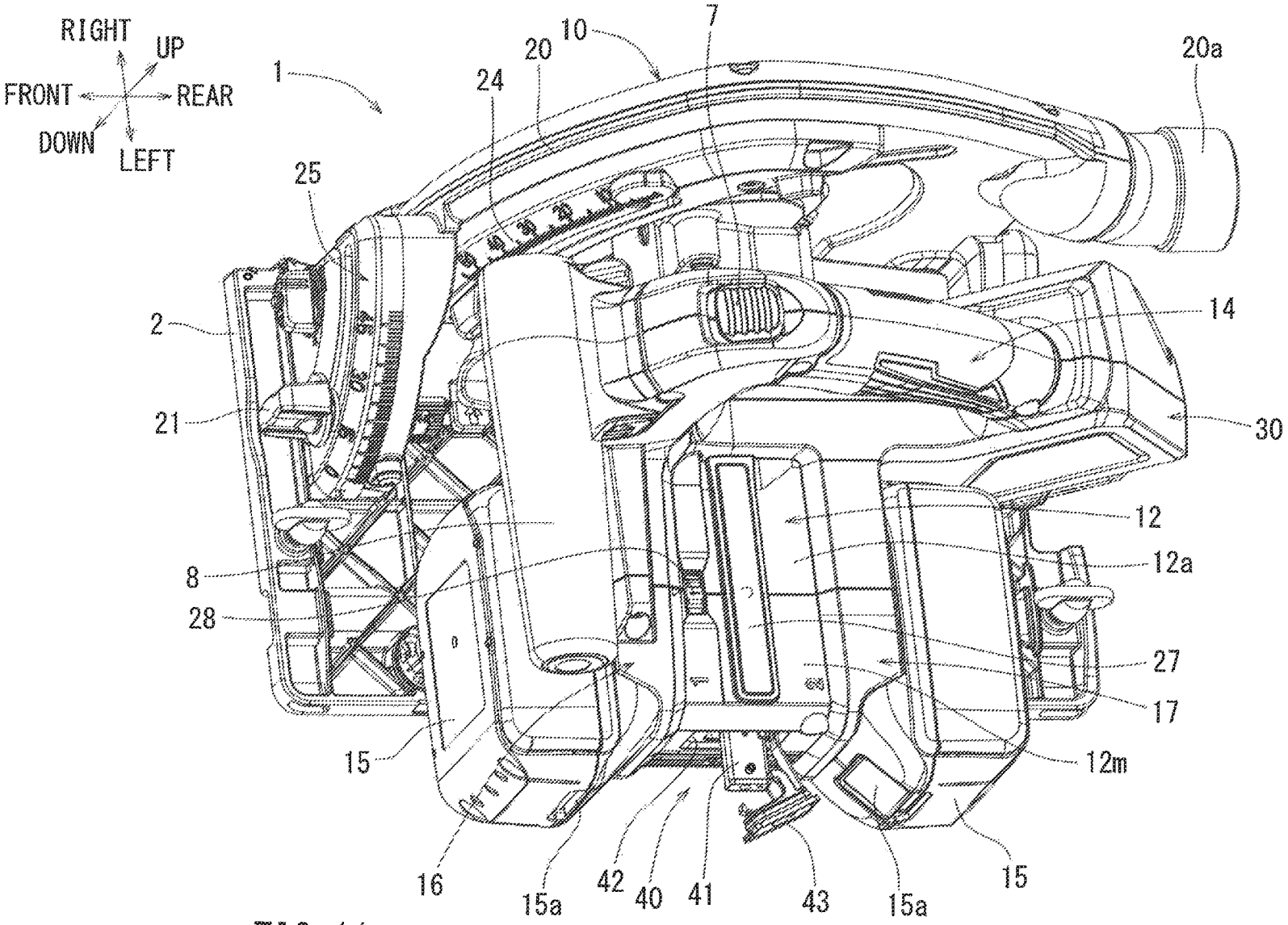
FIG. 11 is a perspective view of a portable machining device according to another embodiment (second embodiment) seen obliquely from the upper left.
Figure 12:
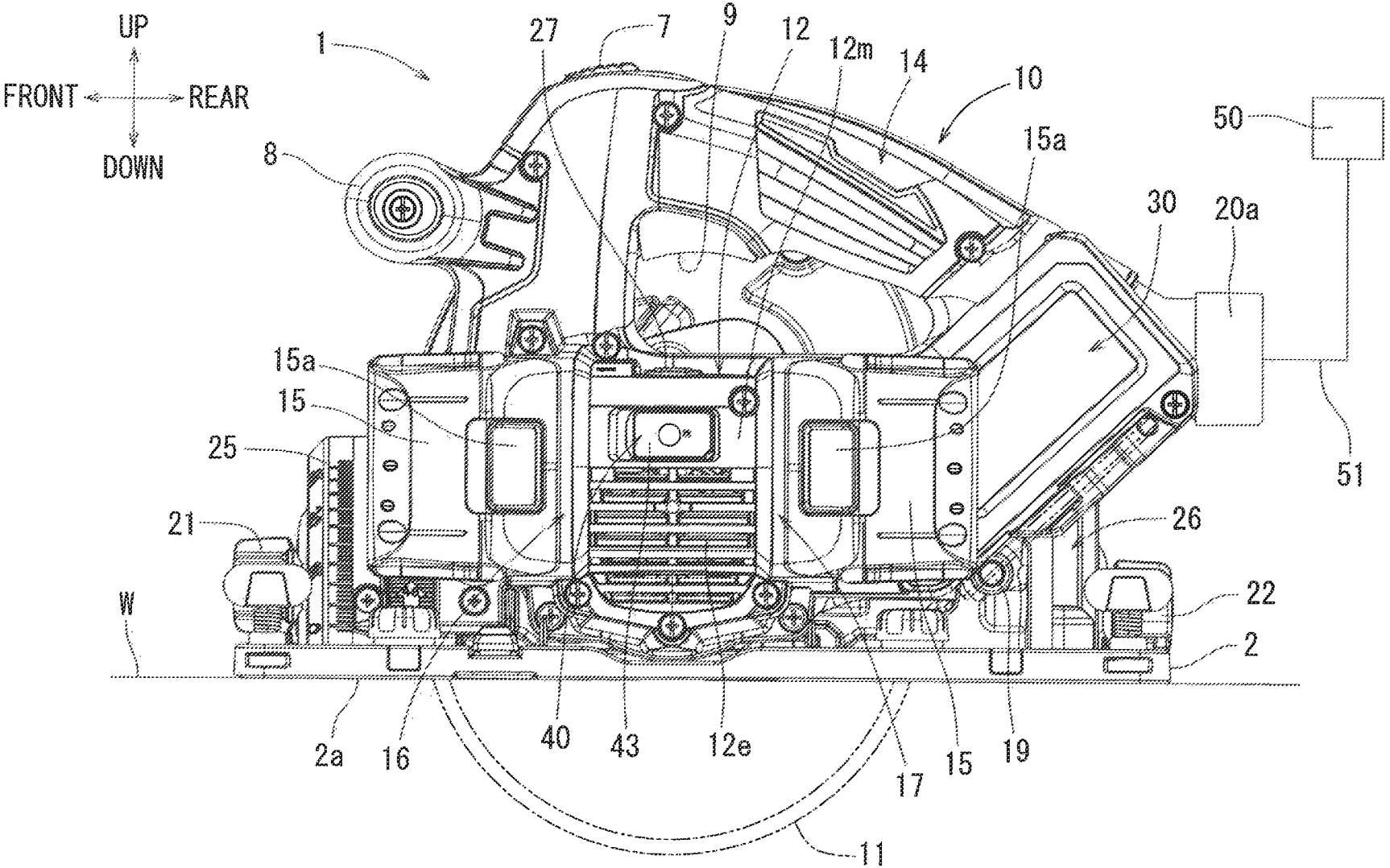
FIG. 12 is a left side view of the portable machining device according to another embodiment (second embodiment), showing a state where the portable machining device main body is moved to a lower end position.
Figure 13:
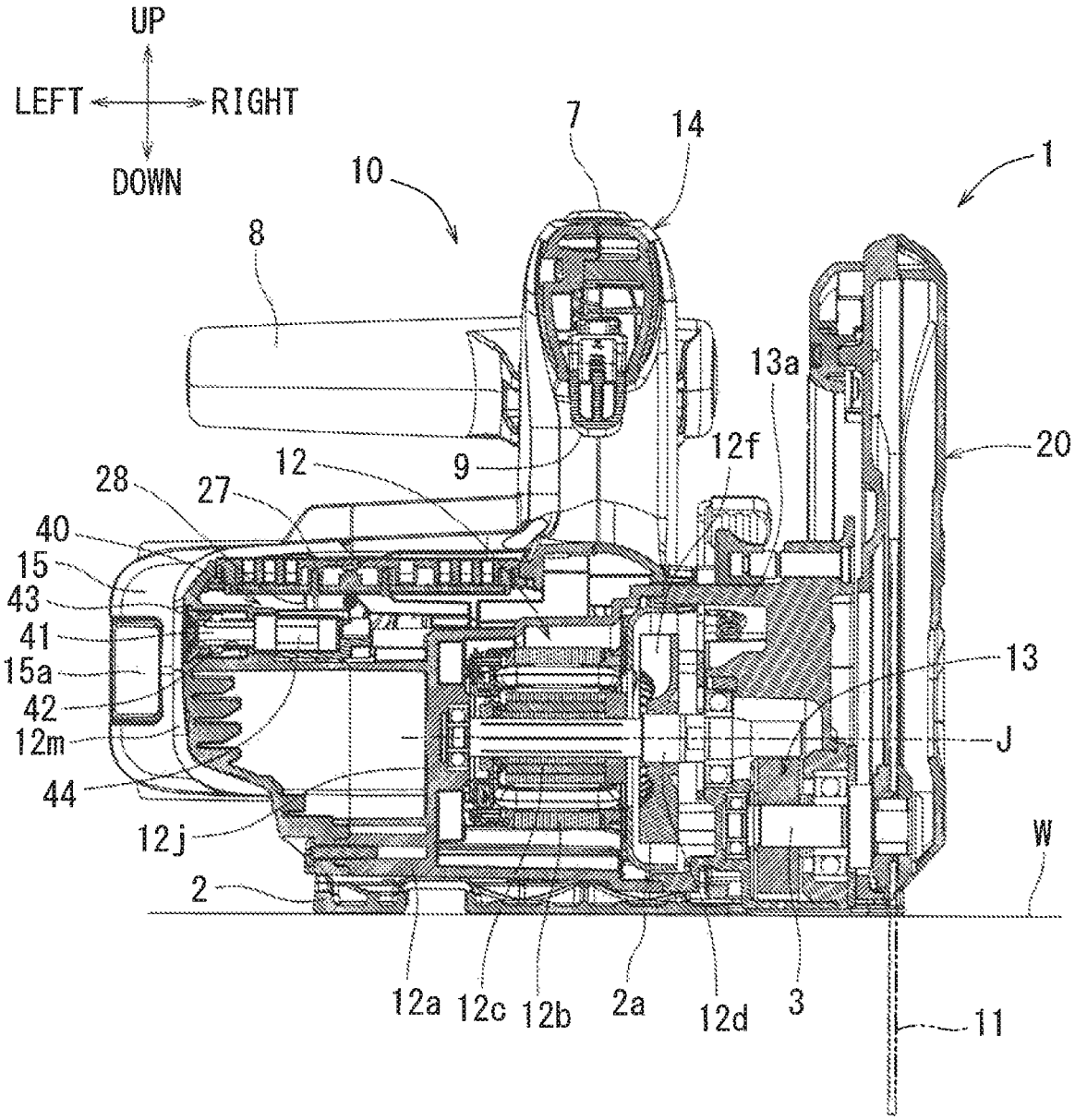
FIG. 13 is a longitudinal cross-sectional view of the portable machining device according to another embodiment (second embodiment), showing a vertical plane passing a rotation center of a cutting blade.

The embodiment discussed above may be further modified without departing from the scope and spirit of the present teachings. FIGS. 11 to 13 show the portable machining device 1 of the second embodiment. The portable machining device 1 of the second embodiment may differ from that of the first embodiment in that the portable machining device 1 of the second embodiment performs the feature of radio communication with incidental devices such as a dust collector etc. The portable machining device 1 of the second embodiment may have the same members and configurations of that of the first embodiment such as the arrangement of the controller 31 etc. Descriptions of the members and configurations in common with the first embodiment may be omitted by using the same reference numerals.

In the second embodiment, a rear cover 12*m* may be provided on the left side of the motor case 12*a*. A radio communication unit 40 may be provided on the inside of the rear cover 12*m*. A communication adapter 41 may be attached to the radio communication unit 40. An adapter insertion portion 42 for inserting the communication adapter 41 may be provided on the left end surface of the rear cover 12*m*. The adapter insertion portion 42 may comprise a rectangular hole and penetrate deep in the rightward direction in the motor case along below the residual capacity display portion 27. As shown in FIG. 13, an adapter receiving portion 44 may be incorporated at the innermost part of the adapter insertion portion 42. By inserting the communication adapter 41 into the adapter insertion portion 42 to connect to the adapter receiving portion 44, the radio communication unit 140 may be able to conduct radio communication between the portable machining device 1 and an incidental device such as the dust collector 50 via the communication adapter 41. The adapter insertion portion 42 may be covered by a cap 43. By inserting the communication adapter 41 into the adapter insertion portion 42 and closing the cap 43, the communication adapter 41 and the adapter receiving portion 44 may be shielded against dust, in a dustproof configuration.

The communication adapter 41 may have been previously associated (paired) with a communication adapter of the specific incidental device such as the dust collector 50 such that radio communication between the two can take place. In a state where the communication adapter 41 is attached to the radio communication unit 40, when the switch lever 9 is switched on to run (start) the portable machining device 1, the start information from the portable machining device 1 may be transmitted through radio communication to the side of the dust collector 50, based on which the dust collector 50 may automatically run. As shown in FIG. 12, by attaching a dust collection hose 51 to the dust collection port 20*a*, the dust collector 50 may be an incidental device of the portable machining device 1, and the dust collector 50 may be in a standby state when powered on.

As discussed above, the portable machining device 1 may be provided with a radio communication function to communicate with the dust collector 50 as an incidental device with regard to, mainly, start and stop operations. Accordingly, the dust collector 50 may automatically start/stop in accordance with a start/stop operation of the portable machining device 1, which can furthermore improve operability and workability of both the portable machining device 1 and the dust collector 50.

Further, a third embodiment of the portable machining device 100 will be explained. As shown in FIGS. 14 to 17, the portable machining device 100 of the third embodiment may be provided with a base 102 that is brought into contact with the upper surface of the workpiece W as well as a machining device main body 110 that is supported on an upper surface side of the base 102. The base 102 may have an approximately rectangular flat-plate shape. A lower surface of the base 102 may be a contact surface 102*a* that is brought into contact with the workpiece W. A cutting blade cover 120 may be supported on an upper surface side of the base 102. A front support portion 125 and a rear support portion 126 may be provided on the upper surface of the base 102 at a forward position and a rearward position, respectively. The front support portion 125 and the rear support portion 126 may be provided parallel to each other in an erect manner. The cutting blade cover 120 may be supported so as to be tiltable in the left-to-right direction via the front support portion 125 and the rear support portion 126.

Figure 16:
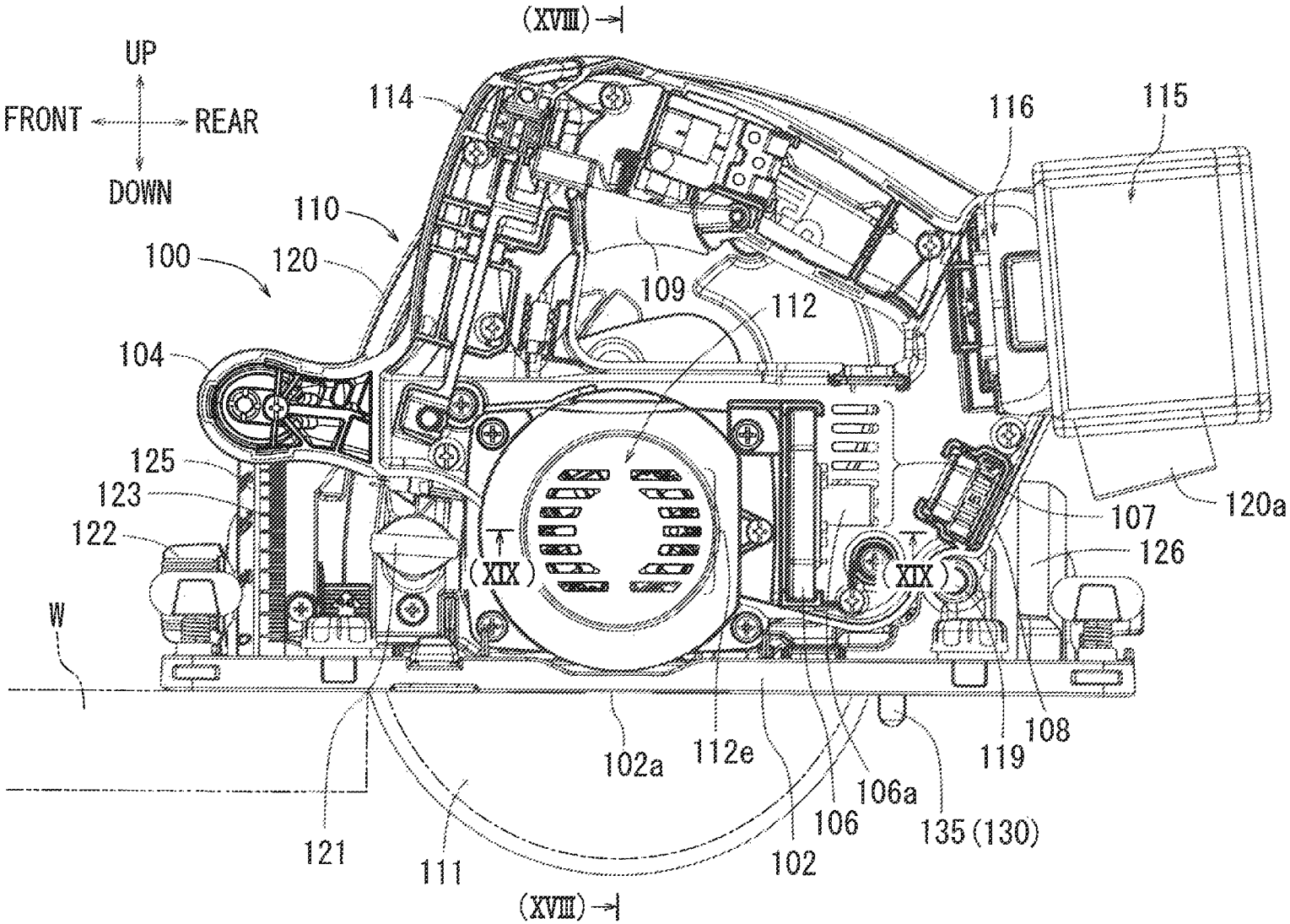
FIG. 16 is a left side view of the portable machining device according to another embodiment (third embodiment), showing an interior of a handle.
Figure 17:
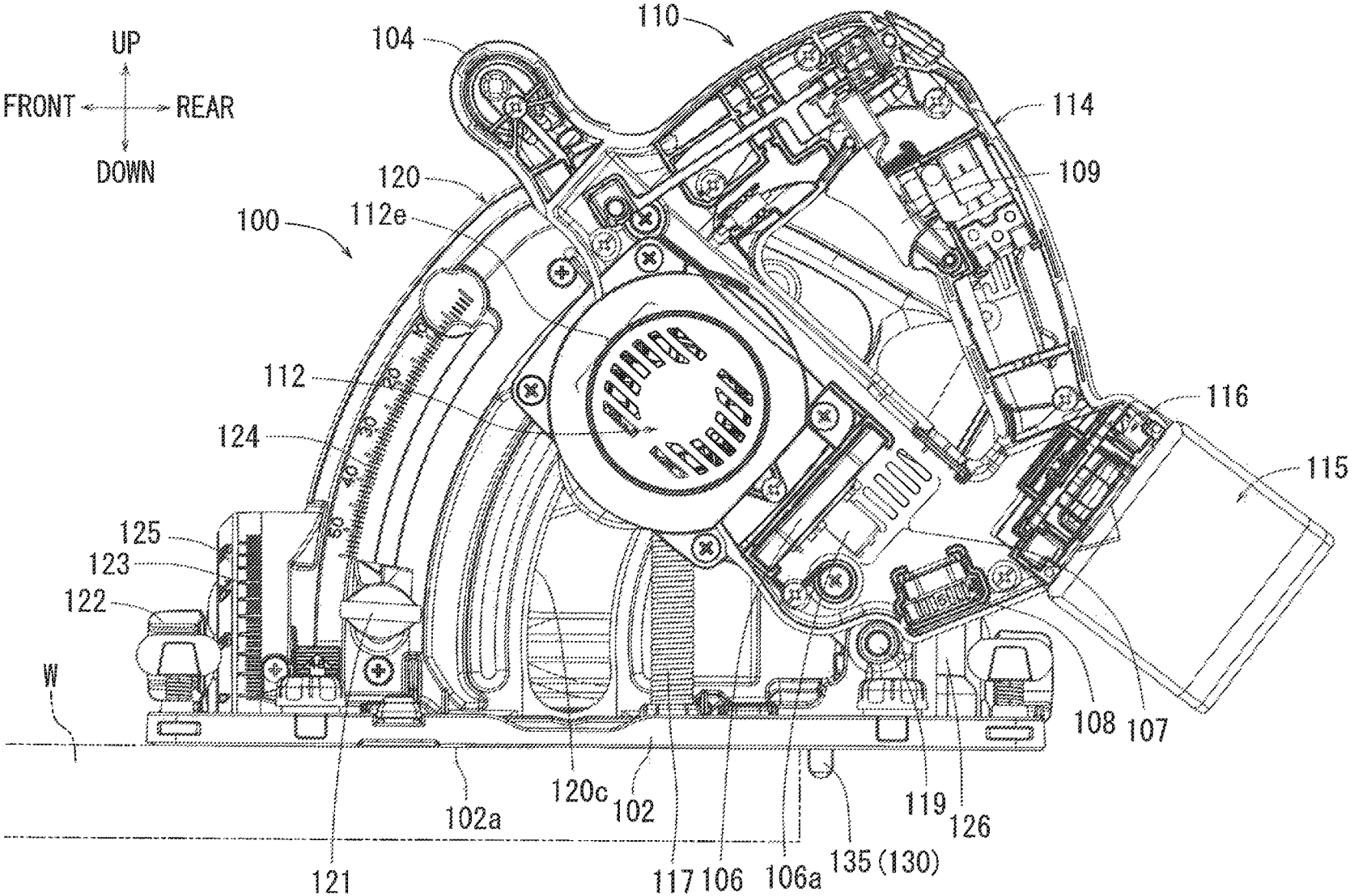
FIG. 17 is a left side view of the portable machining device according to another embodiment (third embodiment), showing a state where the portable machining device main body is held at an upper end position. This figure also shows an interior of the handle.

As shown in FIGS. 16 and 17, the machining device main body 110 may be supported on the left side of the cutting device cover 120 via a main body support shaft 119 about which the machining device main body 110 can swung in the up-to-down direction. A cutting blade 111 may be moved in the up-to-down direction within the cutting blade cover 120 in accordance with an up-to-down movement of the machining device main body 110. The machining device main body 110 may be biased to swing in an upwards direction by a compression spring 117 that is interposed between the machining device main body 110 and the cutting blade cover 120. As shown in FIG. 17, the machining device main body 110 may be held at an upper end position (standby position) by a biasing three of the compression spring 117. A lower portion of the cutting blade 111 may protrude below the contact surface 102*a* of the base 102 in the downward direction when the machining device main body 110 is swung about the main body support shaft 119 in the downward direction against the biasing force of the compression spring 117. By moving the portable machining device 100 in the forward direction while this lowermost protruding state of the cutting blade 111 is being held, the cutting blade 111 can cut into the workpiece W from the blade's front end and a cutting task can be performed. Instead of moving in the forward direction, if the machining device main body 110 is swung in the downward direction while the cutting blade 111 rotates, driven by the driving force of electric motor 112, the lower portion of the rotating cutting blade 111 may protrude below the contact surface 102*a* of the base 102 so as to enter downwards into the workpiece W when performing a cut.

The machining device main body 110 may be supported by the cutting blade cover 120 that in turn can be maneuvered to tilt in the left-to-right direction via the front support portion 125 and the rear support portion 126. Because of this configuration, the cutting blade 111 within the cutting blade cover 120 can also consequently be tilted with respect to the base 102 in the left-to-right direction. By tilting the cutting blade 111 in the leftward/rightward direction, the cutting blade 111 can be used to perform an oblique cut into the workpiece W. A tilt angle of the cutting blade cover 120, and in turn that of the cutting blade 111 within the cutting blade cover 120, may be indicated and measured by lines demarcating angles on an angle scale 123 provided in the front support portion 125 (see FIG. 17). A tilt position of the cutting blade cover 120, and by consequence that of the cutting blade 111 with respect to the base 102 can be adjusted as desired to a particular angle by fastening the fixing screw 122.

Figure 14:
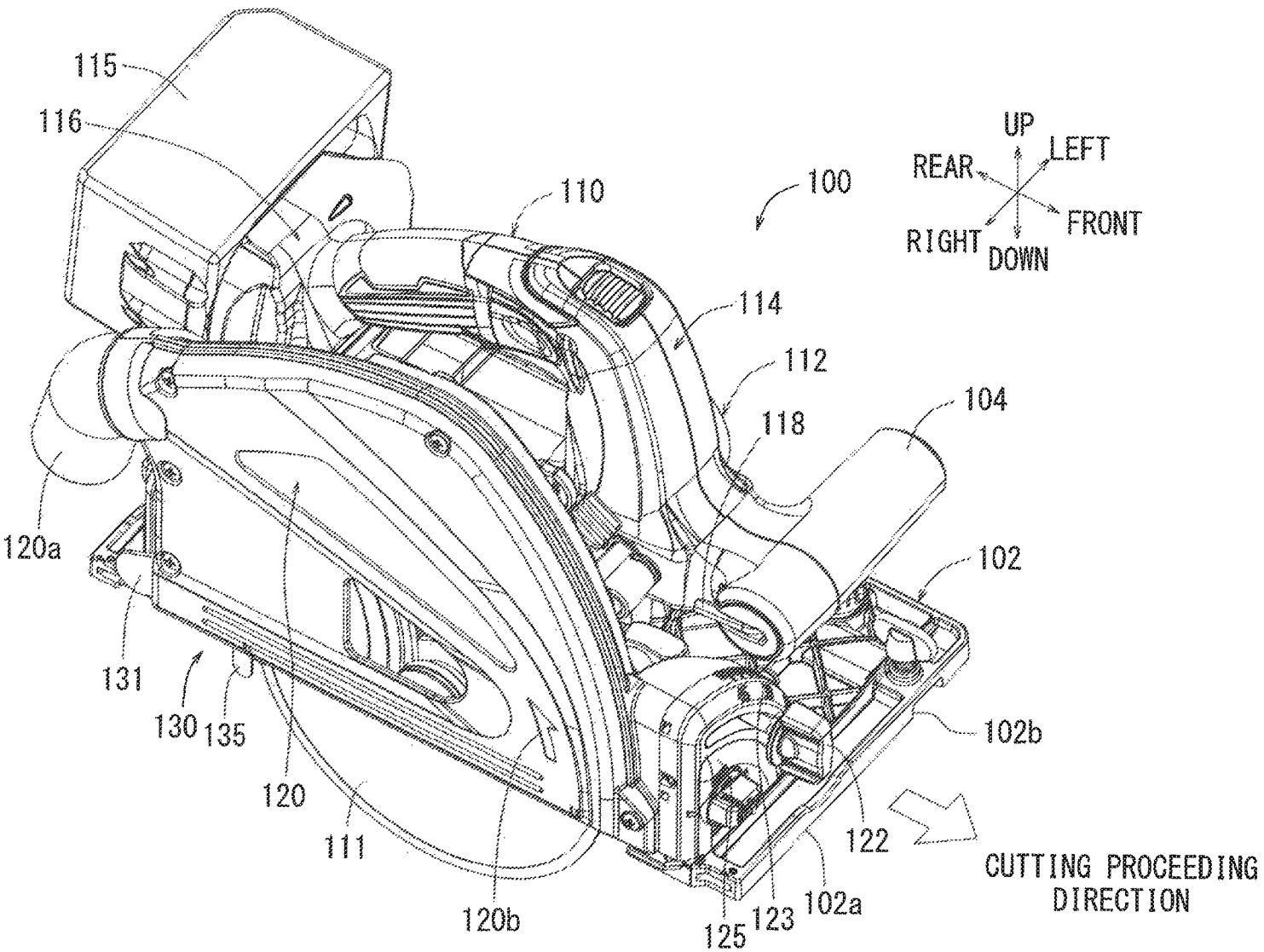
FIG. 14 is an overall perspective view of the portable machining device according to another embodiment (third embodiment).
Figure 15:
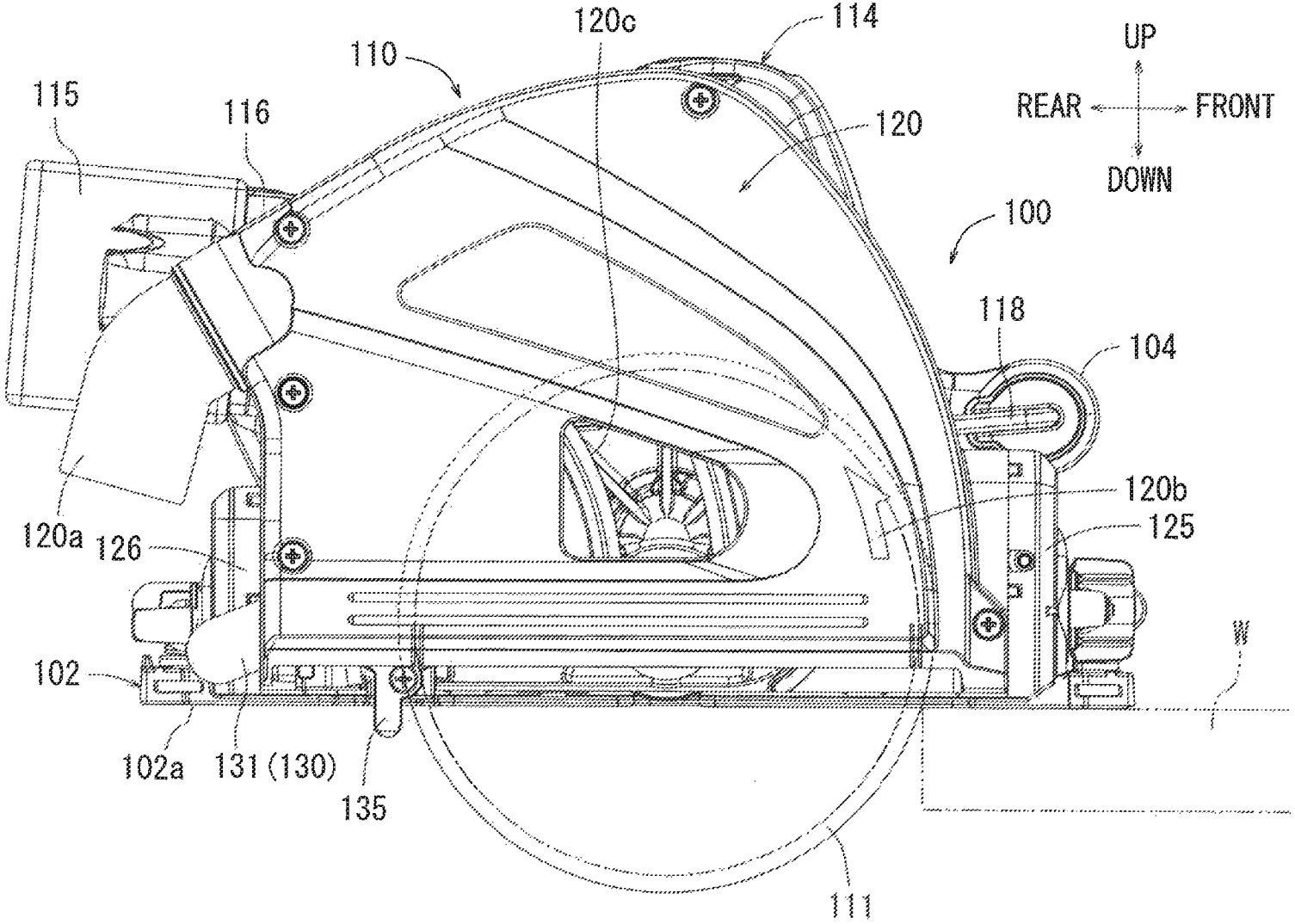
FIG. 15 is a right side view of the portable machining device according to another embodiment (third embodiment).

The cutting blade cover 120 may cover the upper region of the cutting blade 111 above the contact surface 2*a*, which prevents cutting dust from scattering. A dust collection port 120*a* used for connecting a dust collection hose or a dust collection box may be provided at the rear of the cutting blade cover 120. As a result, cutting dust blown out in the proximity of a cutting position (cut-out position by the cutting blade 111), where said dust is generated by rotation of the cutting blade ill and contact with the workpiece W, may flow in the rearward direction, and consequently said cutting dust may be collected through the dust collection port 120*a*. As shown in FIGS. 14 and 15, an arrow 120*b* showing the rotation direction of the cutting blade 111 may be indicated on the right surface side of the cutting blade cover 120.

A swing position (swing angle) of the machining device main body 110 can be fixed to a lower end position or an arbitrary position during a swing operation so as to not be further movable in the downward direction by fastening a fixing screw 121 provided on the left surface side of the cutting blade cover 120. By adjusting the swing position of the machining device main body 110 and fixing the swing position in the up-to-down direction by use of the fastening screw 121, the protruding length of the cutting blade 111 below the contact surface 102*a* can thereby be fixed to an arbitrary and/or a predetermined length. Because of this adjustment, the cutting depth of the cutting blade 111 with respect to the workpiece W can be adjusted and fixed to an arbitrary and/or a predetermined length. As shown in FIG. 17, a cutting depth scale 124 for indicating the cutting depth of the cutting blade 111 may be provided on the left surface side of the cutting blade cover 120.

Figure 18:
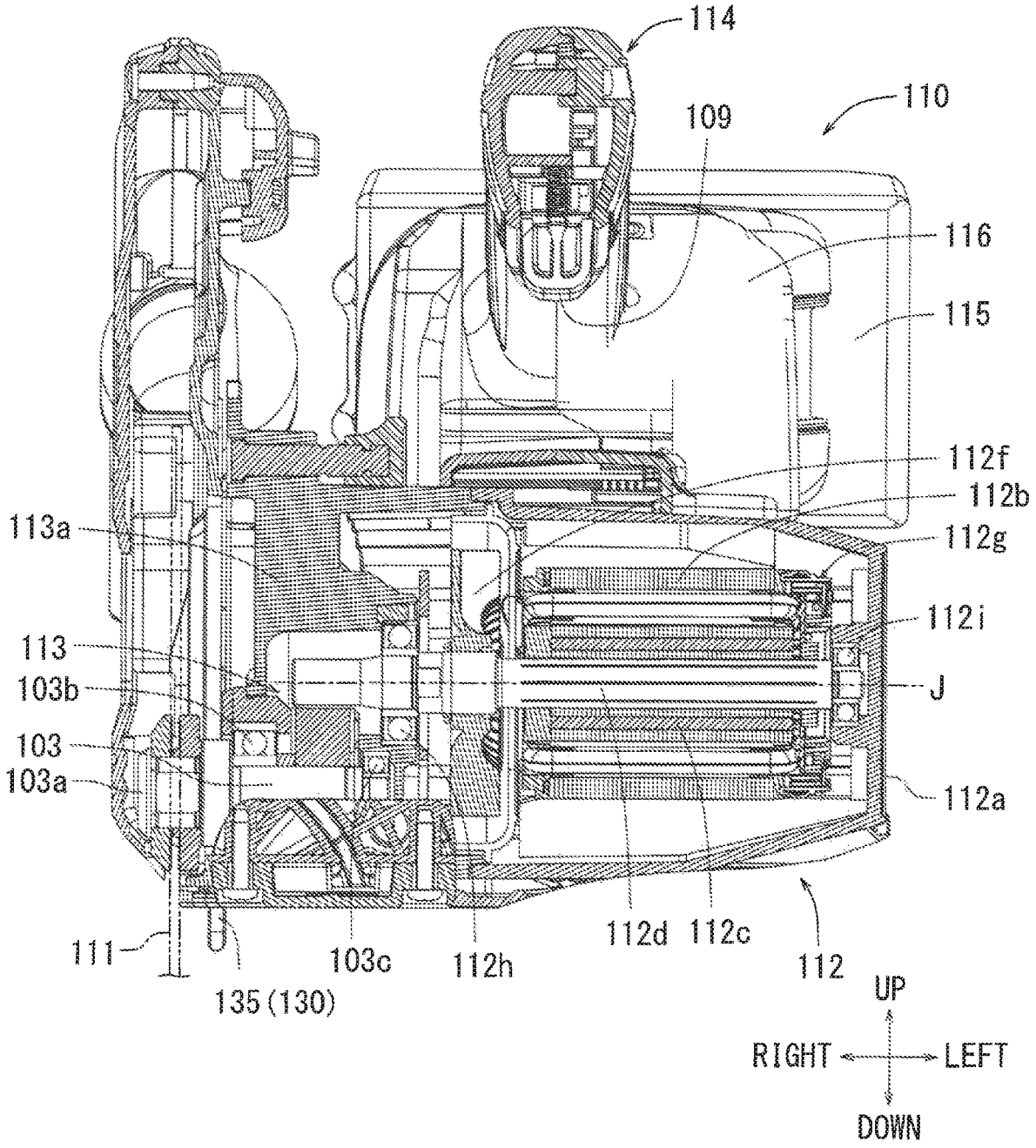
FIG. 18 is a cross-sectional view taken along line (XVIII)-(XVIII) of FIG. 16, showing a longitudinal sectional view of an electric motor.

As shown in FIG. 18, the machining device main body 110 may be provided with the electric motor 112 that serves as the driving source for and rotates the cutting blade 111. The machining device main body 110 may also be provided with a reduction gear portion 113 that houses a reduction gear train for decreasing rotation output of the electric motor 112 in a gear case 13*a*, and a handle 114 that a user holds. The electric motor 112 may be connected to the left side of the reduction gear portion 113.

A DC brushless motor that is powered by a battery pack (DC power source) sewing as a power source can be used as the electric motor 112. The electric motor 112 may be provided with a stator 112*b* that is fixed on a side of a motor case 112*a* as well as a rotor 112*c* that is rotatably supported on an inner circumference of the stator 112*b*. A sensor PCB 112*g* including an electromagnetic sensor for detecting a rotation position of the rotor 112*c* may be attached to the rear surface (left surface) of the stator 112*b* in a direction of a motor axis J. A motor shaft 112*d* that is joined to the rotor 112*c* may be rotatably supported around the motor axis J via a right bearing 112*h* and a left bearing 112*i*. The right bearing 112*h* may be held in the gear case 113*a* and the left bearing 112*i* may be held in a center left wall of the motor case 112*a*.

Figure 19:
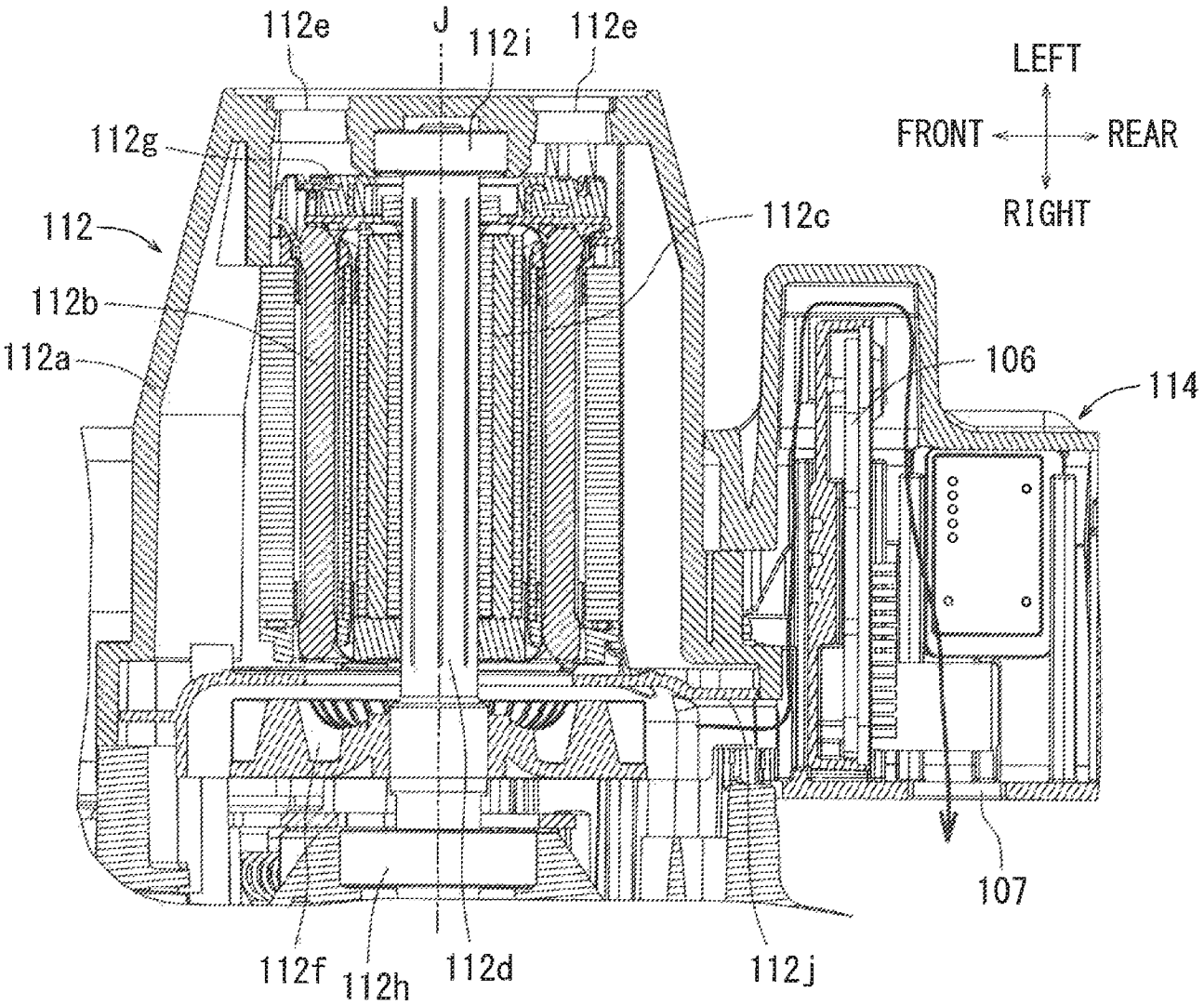
FIG. 19 is a cross-sectional view taken along line (XIX)-(XIX) of FIG. 16, showing a lateral sectional view of the electric motor.

A cooling fan 112*f* may be attached to the motor shaft 112*d*. As shown in FIGS. 16 and 17, a plurality of intake holes 112*e* may be provided on the left side of the motor case 112*a*. When the electric motor 112 is driven, the cooling fan 112*f* attached to the motor shaft 112*d* may rotate synchronously with the motor shaft 112*d*. Due to the rotation of the cooling fan 112*f*, outside air may be introduced into the motor case 112*a* via the intake holes 112*e*. Outside air which flows into the motor case 112*a* may flow in the rightward direction (in the direction of the motor axis J toward the cutting blade 111), cooling the stator 112*b*, the rotor 112*c* and the sensor PCB 112*g*, etc. A ventilation hole 112*j* may be provided on the motor case 112*a* on the lateral side of the cooling fan 112*f* (at the front/rear side of the fan) as shown in FIG. 19. Outside air (motor cooling air) that has cooled the interior of the motor case 112*a* may flow into the interior of the handle 114 via the ventilation hole 112*j*. Outside air which flows into the handle 114 may be used for cooling the controller 106, which will be discussed in detail infra.

Rotation output of the electric motor 112 may be decreased through the reduction gear portion 113 and then transferred to the spindle 103. The spindle 103 may protrude into the interior of the cutting blade cover 120 through an arc-shaped insertion groove hole 120*c* provided on the left side of the cutting blade cover 120. Furthermore, a tip end of the spindle 103 protruding into the interior of the cutting blade cover 120 may be attached to the circular cutting blade 111. The center of rotation of the cutting blade 111 may be fixed by use of a cutting blade fixing screw 103*a* that can be firmly fastened and fixed to the tip end surface of the spindle 103. The spindle 103 may be rotatably supported by the gear case 113*a* via a right bearing 103*b* and a left bearing 103*c*.

As shown in FIGS. 16 and 17, the handle 114 may have a loop shape straddling the upper portion of the motor case 112*a* as well as the rear portion thereof. A trigger-type switch lever 109 which may be pulled inwards by a user's fingertips may be provided on an inner circumference side (lower surface side) of the handle 114. When the switch lever 109 is pulled, the electric motor 112 may run and the cutting blade 115 may rotate.

As shown in FIGS. 14 to 17, a power supply portion 116 for attaching a battery pack 115 may be provided on the rear side of the handle 114. The battery pack 115 may be mechanically and electrically connected to the power supply portion 116 by being slid into said portion in the rightward direction with respect to the power supply portion 116. In contrast, the battery pack 115 may be detached from the power supply portion 116 by being slid out from said portion in the leftward direction, from the right to left. The battery pack 115 that is used for the previous operations can be recharged after being detached from the power supply portion 116 by a dedicated battery charger, such that it may be repeatedly used. The battery pack 115 may be a lithium ion battery within which a plurality of battery cells are incorporated. The battery pack 115 may be attached to an electric power tool such as an electric screwdriver, etc.

As shown in FIGS. 16 and 17, a controller 106 mainly used for controlling the electric motor 112 may be incorporated in the rear of the handle 114 between the power supply portion 116 and the rear surface of the motor case 112*a* in the front-to-rear direction. The controller 106 may be configured such that a control circuit board on which electric components including a capacitor 106*a* etc. are mounted, is housed in a case having a rectangular plate shape and a shallow bottom, wherein the interior of the case is resin molded. As shown in FIG. 16, the controller 106 may be vertically held in the up-to-down direction. The controller 106 may control the electric motor 112, the motor's rotation speed, and/or also perform an auto-stop based on current overload or over-discharge information detected from the battery pack 115. Additionally, an adjustment dial 108 for adjusting the rotation speed of the electric motor 112 may be provided behind the controller 106.

As shown in FIG. 19, the aforementioned ventilation hole 112*j* may be disposed to the front of the controller 106. Motor cooling air may flow into the interior of the handle 114 through the ventilation hole 112*j*. The motor cooling air that flows into the handle 114 through the ventilation hole 112*j* may flow further to the controller 106. Because of this flow path of cooling air, the controller 106 may be cooled. After cooling the controller 106, the air can continue along its flow path to be discharged to the outside from an exhaust hole 107 provided on the right side of the handle 114. FIG. 19 shows a thick solid line depicting the flow path of the motor cooling air from the ventilation hole 112*j* to the exhaust hole 107. In this way, by being present in this flow path, the controller 106, in which heat generation sources such as the capacitor 106*a* etc. are mounted may be effectively cooled by use of the motor cooling air.

A front grip 104 may be provided at the front of the handle 114. As shown in FIG. 14, the front grip 104 may extend from the front portion of the handle 114 in the leftward direction. The user may hold the handle 114 with one hand and the front grip 114 with their other hand in order to easily operate the portable machining device 100 in a stable manner. A hexagon wrench 118 may be inserted into and held on the right side of the front grip 104. The aforementioned fixing screw 103*a* for fixing the cutting blade 111 may be fastened and/or loosened by use of the hexagon wrench 118. In this way, the detachable hexagon wrench 118 which can be used for exchanging the cutting blade 111 may be held on the front grip 104, which in turn can improve convenience.

Figure 21:
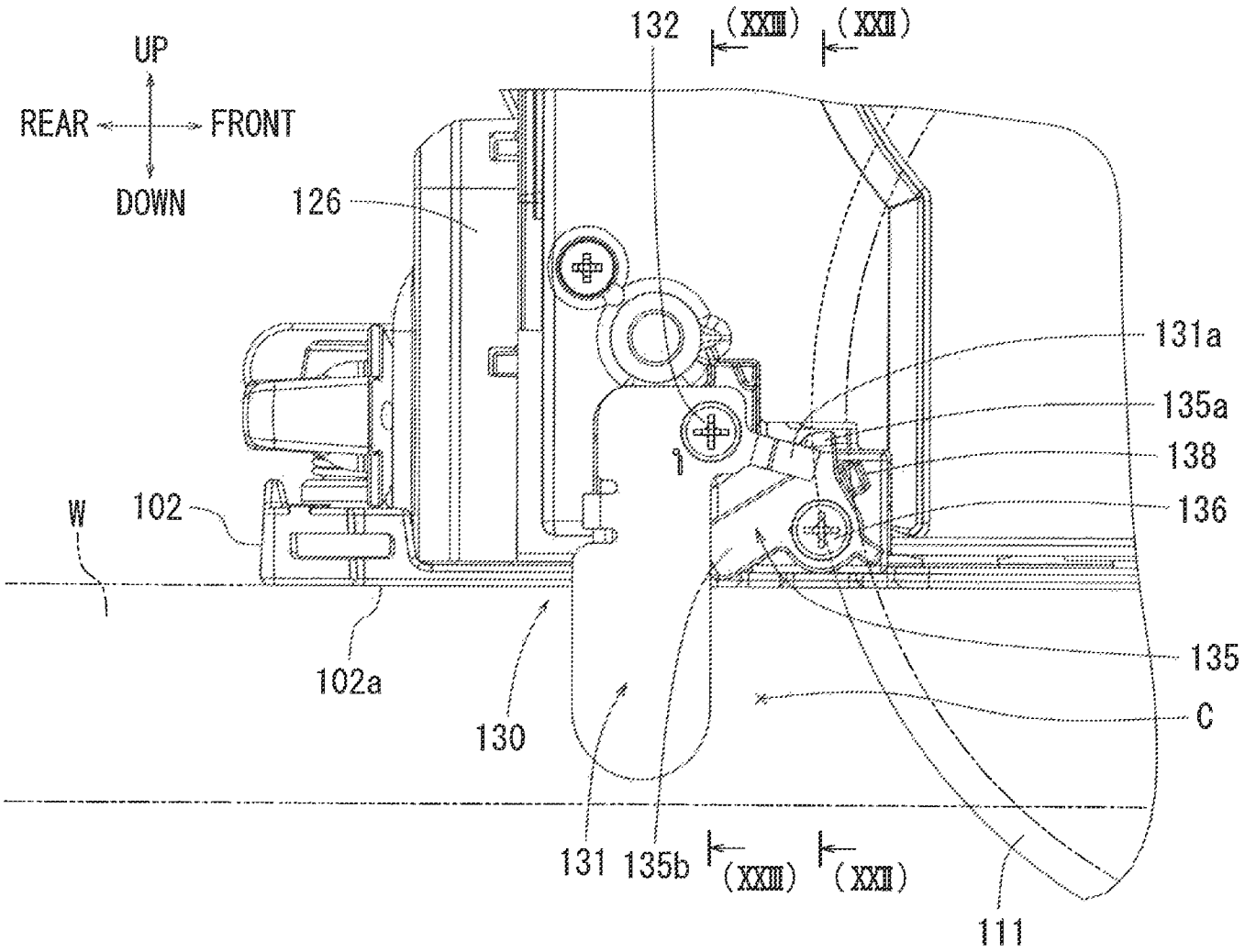
FIG. 21 is a right side view of the guide member and its surroundings. This figure also shows a state where the guide member is moved to a guiding position and the holding member is situated at a holding release position.

A cutting blade guide 130 for assisting smooth rotation of the cutting blade 111 may be provided behind the cutting blade 111. The cutting blade guide 130 may include a guide member 131 as well as a holding member 135. The guide member 131, which is referred to as a wedge knife or a riving knife, may function in such a manner as to be inserted into a cutting groove C immediately after a cutting task is performed in order to hold the width of the cutting groove C to approximately the width of the cutting blade 111, as shown in FIG. 21. Because of the presence of the guide member 131, the width of the cutting groove C may be held in a constant manner and thus a smooth finish by the cutting blade 111, wherein the presence of said guide member 131 reduces rotational resistance encountered when the cutting blade 111 contacts the workpiece W. As a result, cutting accuracy can be improved.

Figure 20:
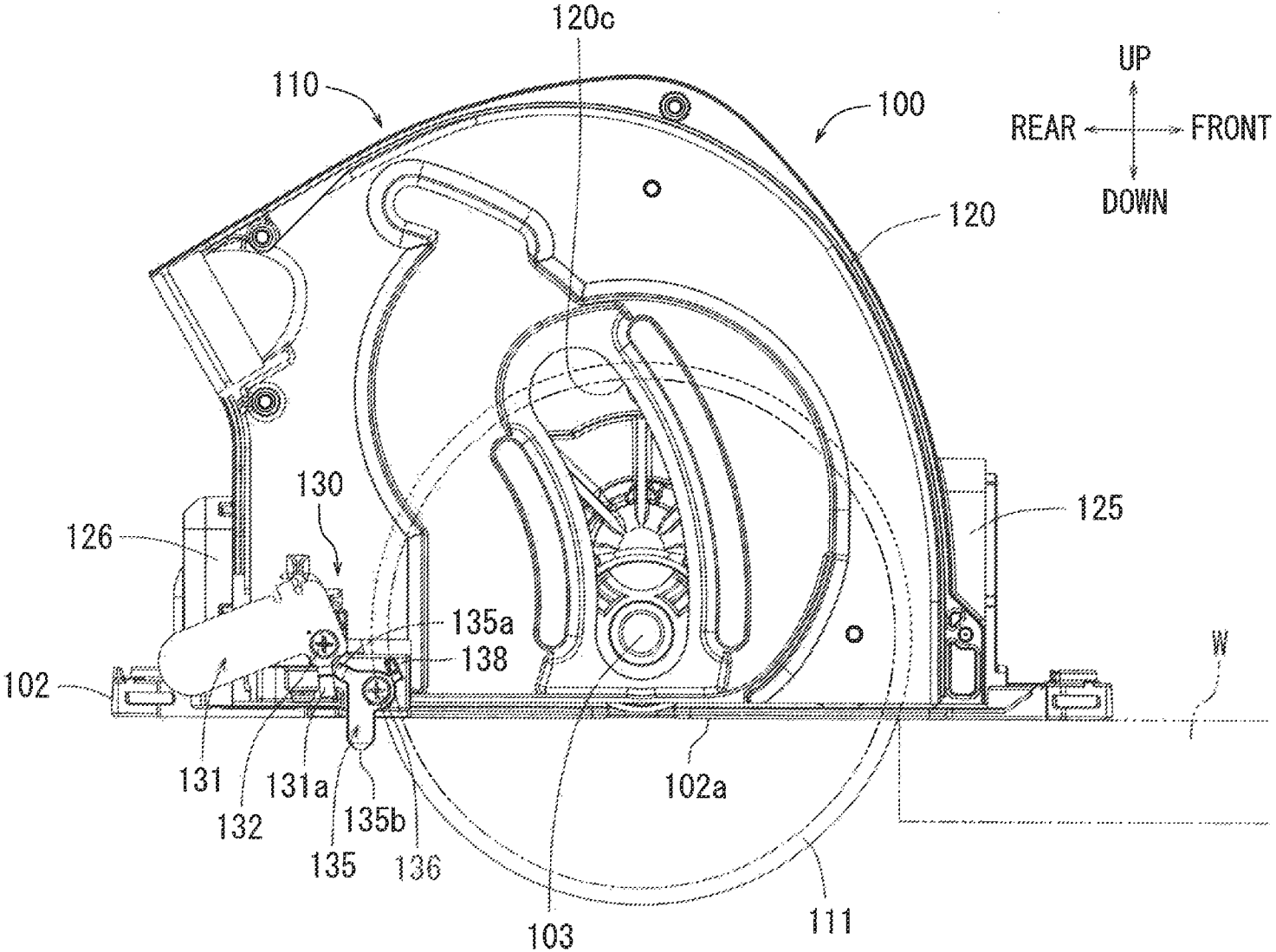
FIG. 20 is a right side view of the portable machining device according to another embodiment (third embodiment), showing a state where a right side cutting blade cover is removed from the portable machining device main body. This figure also shows a state where a guide member is returned to a retreat position and a holding member is situated at a holding position.

As shown in FIG. 20, the guide member 131 may be supported behind the cutting blade 111 in the front-to-rear direction on the inner side of the rear portion of the cutting blade cover 120. Furthermore, the guide member 131 may be provided so as to be rotatable in the up-to-down direction about a support shaft 132. The guide member 131 may be moved between a retracted position shown in FIG. 20 and a guiding position shown in FIG. 21.

Figure 23:
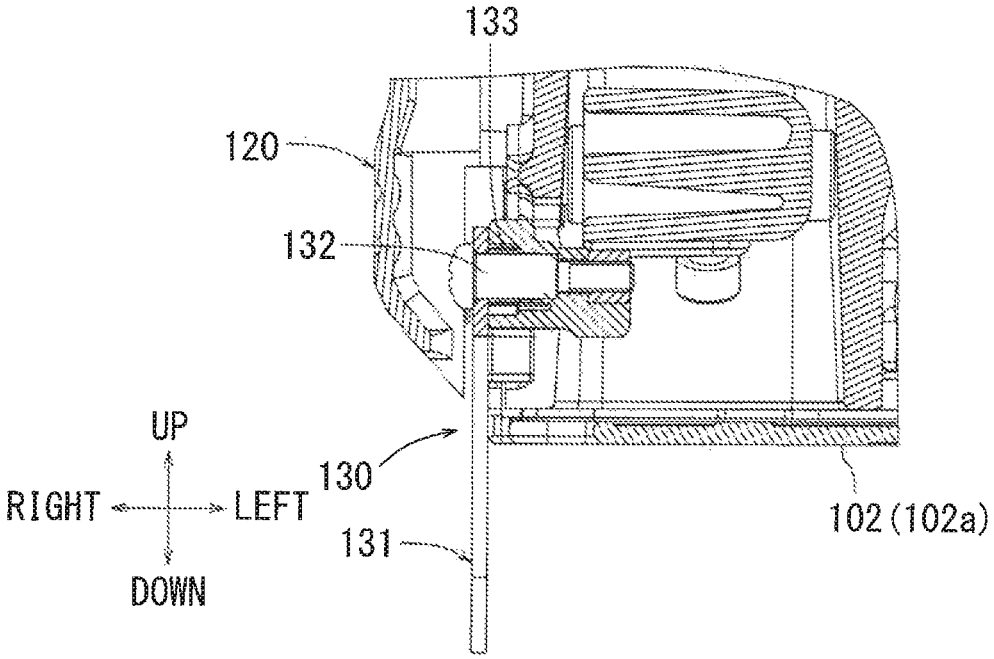
FIG. 23 is a cross-sectional view taken along line (XVIII)-(XVIII) of FIG. 21, showing the guide member and its surroundings.

The guide member 131 may be made of a thin steel plate with approximately the same width as that of the cutting blade 111, and its rotation tip end at its outer radial end may be formed in a semicircular shape. As shown in FIG. 23, the guide member 131 may be biased by a first biasing member 133 such that the rotation tip end of the guide member 131 moves in the downward direction (counterclockwise direction in FIG. 20). A torsion spring may be used as the first biasing member 133. When the guide member 131 is moved (taken out) to the guiding position shown in FIG. 21 by the biasing force of the first biasing member 133, the rotation tip end (lower end) of the guide member 131 may be inserted (enter) into the cutting groove C immediately after the cutting. By inserting the guide member 131, which has approximately the same width as that of the cutting blade 111, into the cutting groove C, the cutting groove C can be fixedly held at a width approximately as wide as that of the cutting blade 111.

Figure 22:
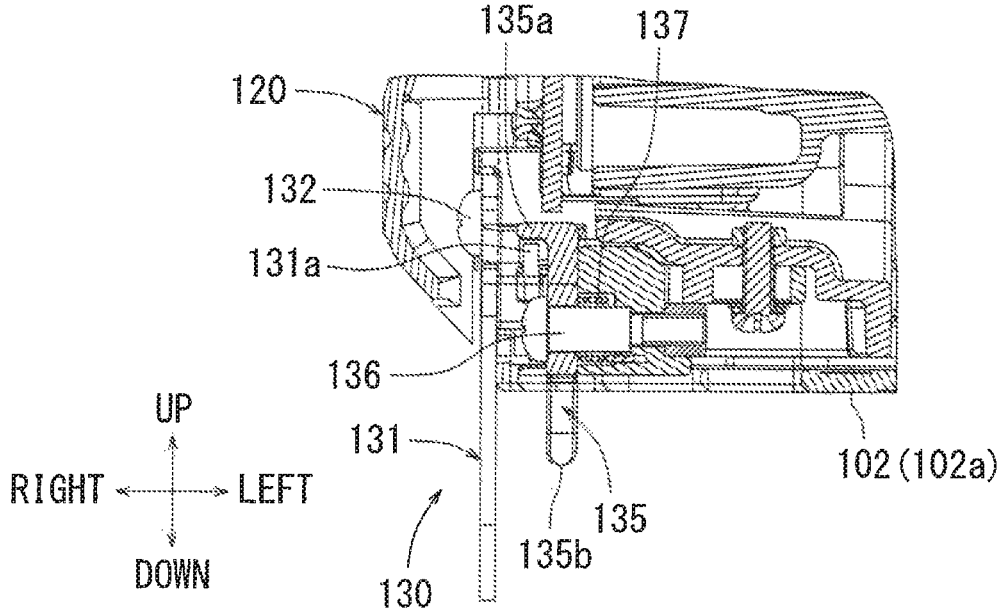
FIG. 22 is a cross-sectional view taken along line (XXII)-(XXII) of FIG. 21, showing the holding member and its surroundings.

As shown in FIG. 20, the guide member 131 may be held by the holding member 135 in the retraction position where the guide member 131 rotates clockwise in the upward direction. The holding member 135 may be provided to the front of the guide member 131 so as to be rotatable in the up-to-down direction about a support shaft 136. The holding member 135 may be provided so as to be rotatable between a hold-release position shown in FIG. 21 and a hold position shown in FIG. 20 via the support shaft 136. As shown in FIG. 22, the holding member 135 may be biased by a second biasing member 137 in a direction in which the holding member 135 rotates from the hold-release position shown in FIG. 21 to the hold position shown in FIG. 20 (in the counterclockwise direction).

A torsion spring may be used as the second biasing member 137, wherein the biasing force of said spring is larger than that of the first biasing member 133. As shown in FIG. 20, a holding engaging portion 135*a* extending in the rearward and upward directions may be integrally formed with the holding member 135. Corresponding to the holding engaging portion 135*a*, an engaging receiving portion 131*a* may be integrally formed with the front portion of the guide member 131. The engaging receiving portion 131*a* may engage with the lower portion of the holding engaging portion 135*a*. Because of this engagement configuration, as shown in FIG. 21, in a state where the holding member 135 is disposed in the hold-release position against the biasing force of the second biasing member 137, the holding engaging portion 135*a* may be retracted in the upward direction and concomitantly, the engaging receiving portion 131*a* may also be allowed to move in the upward direction. As a result, the guide member 131 may be moved (taken out) to the guiding position by the biasing force of the first biasing member 133.

In contrast, as shown in FIGS. 20-23, in a state where the holding member 135 is moved to the hold position by the biasing force of the second biasing member 137, the holding engaging portion 135*a* may be moved in the downward direction rotating counter-clockwise and concomitantly the engaging receiving portion 131*a* may be pushed in the downward direction, rotating clockwise. As a result, the guide member 131 may be returned to the retraction position against the biasing force of the first biasing member 133.

As shown in FIG. 20, when the holding member 135 is moved to the hold position by the biasing force of the second biasing member 137, the rotation tip end at the outer radial length of the holding member 135 (detection portion 135*b*) may protrude below the contact surface 102*a* of the base 102. A rotation end position of the holding member 135 in a direction toward the hold position by the biasing force of the second biasing member 137 may be restricted by a stopper 138. In more detail, the stopper 138 may be positioned such that the detection portion 135*b* of the holding member 135 does not rotate further past a predetermined extent in the counterclockwise direction, where the maximum extent of rotation for the detection portion 135*b* is the vertical downward pointing direction perpendicular to the contact surface 102*a* of the base 102, where the rotation tip end of the holding member 135 is displaced a little in the rearward direction. Because of this configuration, when the contact surface 102*a* of the base 102 is brought into contact with the upper surface of the workpiece W and then the detection portion 135*b* of the holding member 135 is brought into contact with the upper surface of the workpiece W, which pushes upward in turn on the holding member 135, the holding member 135 may rotate to the hold-release position against the biasing force of the second biasing member 137 as shown in FIG. 21. This is because the weight of the portable machining device 100 contributing to the force of the workpiece W pushing upward on the holding member 135 is larger than the biasing force of the second biasing member 137. Furthermore, in a cutting task where the cutting blade 111 cuts into a front end portion of the workpiece W, the end portion of the workpiece W may be brought into contact with the detection portion 135*b* as the portable machining device 100 moves further forward. In this state of contact of the workpiece W with the detection portion 135*b*, the portable machining device 100 may be moved forward in the cutting proceeding direction and concomitantly the holding member 135 may rotate to the hold-release position against the biasing force of the second biasing member 137 as shown in FIG. 21.

When the holding member 135 rotates to the hold-release position, a pressed-down state of the engaging receiving portion 131*a* caused by the holding engaging portion 135*a* may be released. As a result, the guide member 131 may be moved (taken out) to the guiding position (in a vertical direction intersecting the contact surface 102*a*) by the biasing force of the first biasing member 133, in the counter-clockwise direction. By inserting the guide member 131, the width of which is approximately the same as the cutting blade 111, into the cutting groove C of the workpiece W, the groove width of the cutting groove C may be held to be the same width as that immediately after it has been cut by the cutting blade 111. Because of this feature of the guide member 131, rotational resistance encountered due to the width of cutting groove C becoming smaller post-cutting, may be restricted, and thus smooth rotation of the cutting blade 111 can be obtained to perform the cutting task precisely.

When the contact surface 102*a* of the base 102 is spaced away from the upper surface of the workpiece W by, for example, lifting the portable cutting device 100 up from the workpiece W after the cutting task is finished, the pressed-up state of the detection portion 135*b* caused by the force of workpiece W pushing upwards on the detection portion 135*b* may be released, and thus the holding member 135 may be returned to the hold position shown in FIG. 20 by the restoring biasing force of the second biasing member 137. In a process where the holding member 135 returns to the hold position, the engaging receiving portion 131*a* may be pressed down by the holding engaging portion 135*a* as the holding engaging portion 135*a* moves in the counter-clockwise direction and thus the guide member 131 may automatically returned to the retraction position shown in FIG. 20 against the biasing force of the first biasing member 133 when the portable cutting device 100 is lifted up from the workpiece W. In this way, when unused for its guiding function, the guide member 131 can automatically return to the retraction position along the upper surface of the base 102 (in a direction where the guide member 131 may not protrude on the side of the contact surface 102*a*). In the retraction position, the guide member 131 along its longitudinal direction may be disposed along the upper surface of the base 102. Additionally, when the guide member 131 is held in the retraction position, the guide member 131 at its radially outward longitudinal end does not protrude below the contact surface 102*a*. Because of this configuration, damage of other members caused by interference thereof with respect to the workpiece W may be previously prevented.

According to the portable machining device 100 of the present embodiment as discussed above, as to the cutting blade guide 130, both the rotation center of the guide member 131 (support shaft 132) and the rotation center of the holding member 135 (support shaft 136) may be located behind (to the rear and left of) the cutting blade 111. Furthermore, the range of rotation of the guide member 131 as well as that of the holding member 135, in the area to the rear and left of the cutting blade 111 and beneath the base 102 may be relatively small. Because of this configuration, in comparison to a conventional device in which this type of the guide member provided in a cutting device main body is moved together in an up-to-down movement of the cutting device main body, an overall movement area of the guide member 131 may be reduced and thus compact structure of the cutting blade cover 120 can be obtained, while at the same time reducing rotational resistance as described above.

A conventional guide member disclosed in, for example, European Patent Publication No. 2638995, is configured to be supported on the side of the cutting device main body and is configured to be moved in the up-to-down direction together with the cutting blade within the cutting blade cover. When the conventional guide member is moved together with the cutting blade in the up-to-down direction, a space for movement may be needed in the cutting blade cover. As a result, the cutting blade cover may be enlarged and compact structure thereof may become difficult. Furthermore, a guide member disclosed in, for example, Japanese Laid-Open Patent Publication No. 2014-04723, is configured to be fixed to a guide position protruding below a lower surface of the base and not to be moved in the up-to-down direction and thus a space for movement may not be (originally) needed in the cutting blade cover. According to the exemplified embodiment of the present teaching, a compact structure of the cutting blade cover can be obtained by improving a supporting configuration of the guide member.

Figure 24:
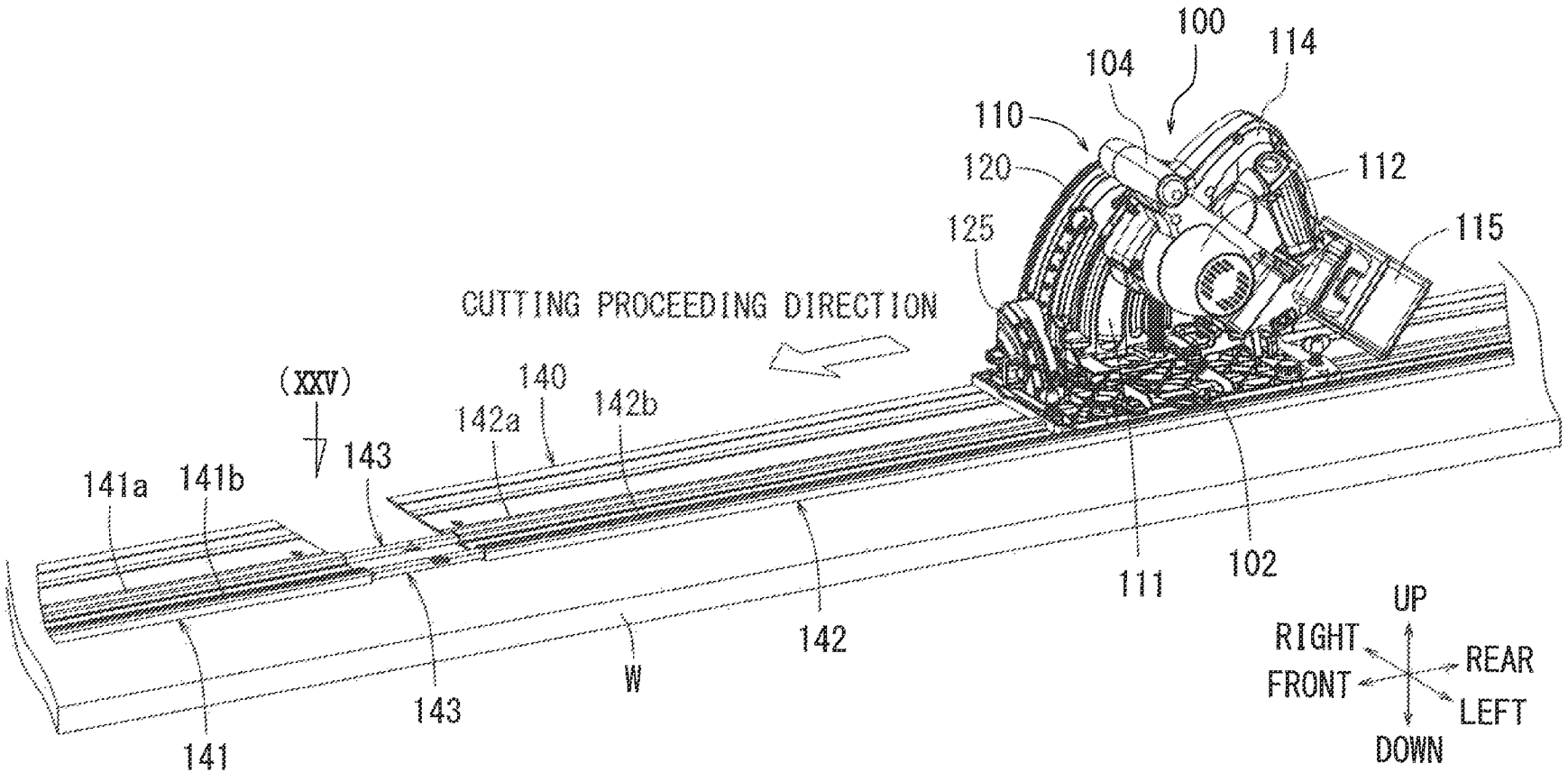
FIG. 24 is an overall perspective view of the portable machining device according to another embodiment (third embodiment), showing a state where the portable machining device is placed on a long ruler.

By use of the portable machining device 100, the user can perform a cutting task by directly contacting the contact surface 102*a* of the base 102 towards the workpiece W. Additionally, when cutting, for example, aluminum composite material etc. or performing a groove cutting, a long ruler 140 may be placed on the upper surface of the workpiece W and the portable machining device 100 may be also placed on the long ruler 140 such that it may slide along the ruler 140 to perform such a cutting as shown in FIG. 24. By using the long ruler 140, it may be possible to precisely and accurately cut the workpiece W over a long distance.

The long ruler 140 may have the following features that conventional devices do not possess. The long ruler 140 may have a configuration where a front-side first ruler 141 is combined to a rear-side second ruler 142. The first ruler 141 and the second ruler 142 may be mutually combined to each other via a ruler connection member 143. Both the first ruler 141 and the second ruler 142 may be made of drawn aluminum.

Figure 28:
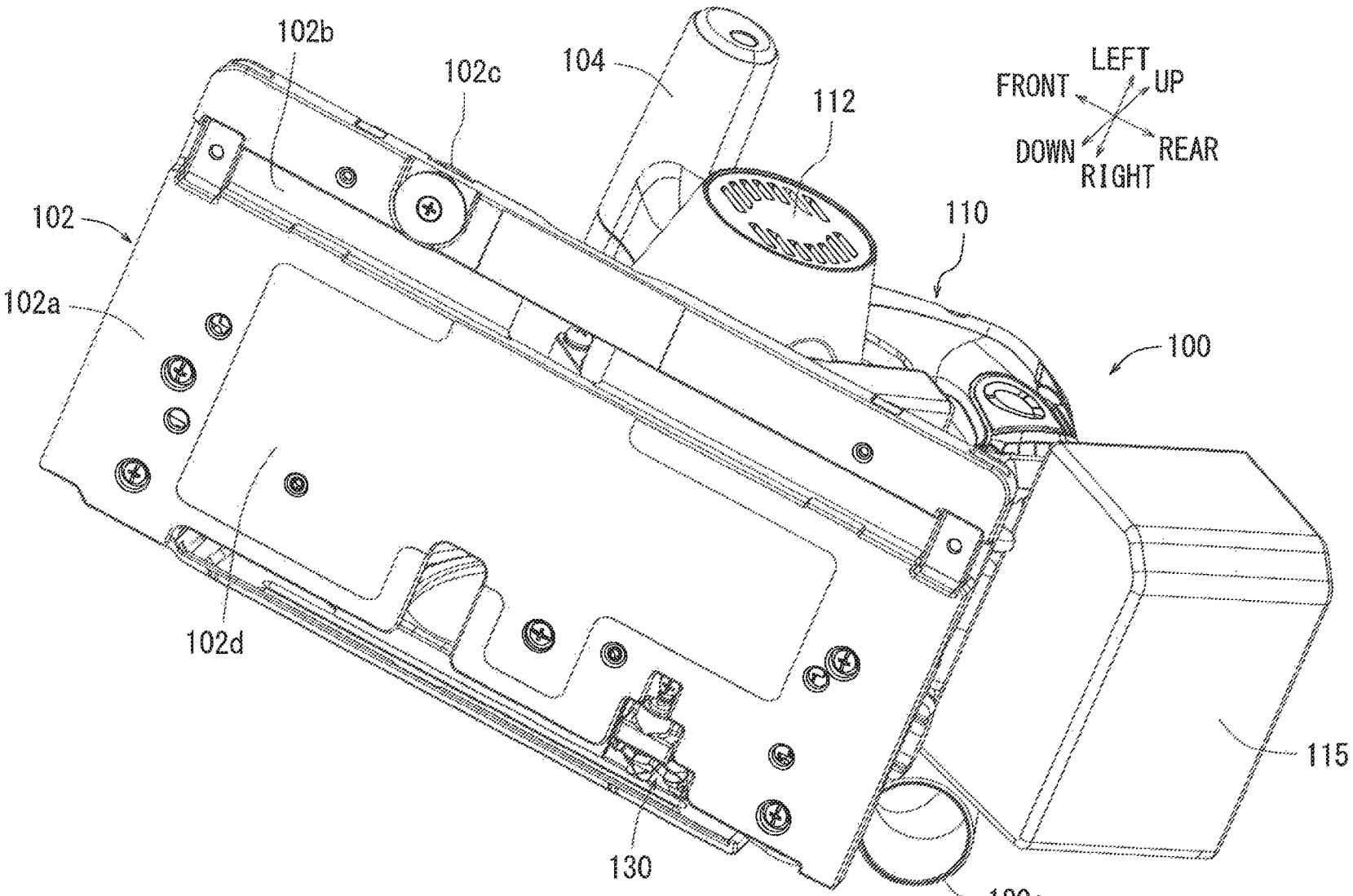
FIG. 28 is a perspective view of the portable machining device, seen from a lower surface of a base.

A first rail 141*a* and a second rail 141*b* for guiding the portable machining device 100 may be provided on the upper surface of the first ruler 141. Similarly, a first rail 142*a* and a second rail 142*b* may be provided on the second ruler 142. The first rails 141*a* and 142*a* may be formed to be rectangular in cross section having a recessed groove shape and convex in the upward direction (open in the downward direction). Corresponding to this, as shown in FIG. 28, a rail receiving portion 102*b* for receiving the first rails 141*a* and 142*a* may be provided on the contact surface 102*a* of the base 102. The rail receiving portion 102*b* may be formed to be recessed and rectangular in cross section and extend from the front end to the rear end of the base, having sufficient width and depth such that the first rails 141*a* and 142*a* can be firmly inserted thereto without rattling.

Figure 27:
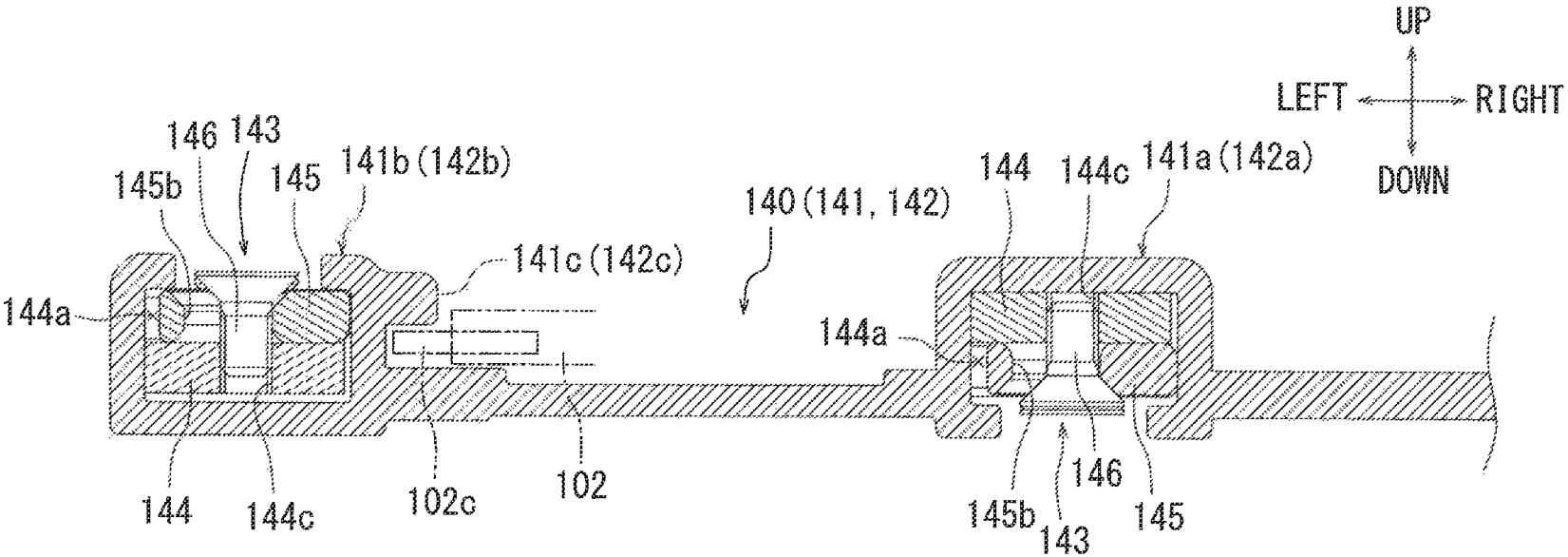
FIG. 27 is a cross-sectional view taken along line (XXVII)-(XXVII) of FIG. 25, showing a lateral sectional view of the long rulers and the connecting portion.

The second rails 141*b* and 142*b* may be formed to be rectangular in cross section having a recessed groove shape and may be configured to be open in the upward direction. That is, the second rails 141*b* and 142*b* may be disposed upside down with respect to the first rails 141*a* and 142*a*. The second rails 141*b* and 142*b* may also be disposed parallel to the first rails 141*a* and 142*a*. Furthermore, groove width of the second rails 141*b* and 142*b* may be the same as that of the first rails 141*a* and 142*a*. As shown in FIG. 24, the second rails 141*b* and 142*b* may be provided to be spaced adjacent to the immediate left of the left edge of the base 102 and extend therealong. Furthermore, as shown in FIG. 27, engaging edges 141*c* and 142*c* may be provided on the right side of the second rails 141*b* and 142*b*. Corresponding to this configuration, as shown in FIG. 28, an engaging plate 102*c* for preventing the portable machining device 100 from falling down may be provided on the left side of the base 102. The engaging plate 102*c* has adjustable fixable length in the left-to-right direction, and may be fixed in either one of the locations so as to extend from the left edge of the base 102 or so as not to extend therefrom. As shown in FIG. 27, by extending the engaging plate 102*c* outward (to the left) relative to the left edge of the base 102, and thereby inserting the engaging plate 102*c* into the lower side of the engaging edge 141*c* and 142*c* in a state where the portable machining device 100 is placed on the long ruler 140, the portable machining device 100 can be prevented from falling down. As shown in FIG. 28, a sliding plate 102*d* for improving sliding ability with respect to the long ruler 140 may be attached to the contact surface 102*a* of the base 102. By improving sliding ability of the base 102 with respect to the long ruler 140 by use of the sliding plate 102*c*, the portable machining device 100 can be easily moved and thus operability of the portable machining device 100 for performing a cutting task can be improved.

Figure 25:
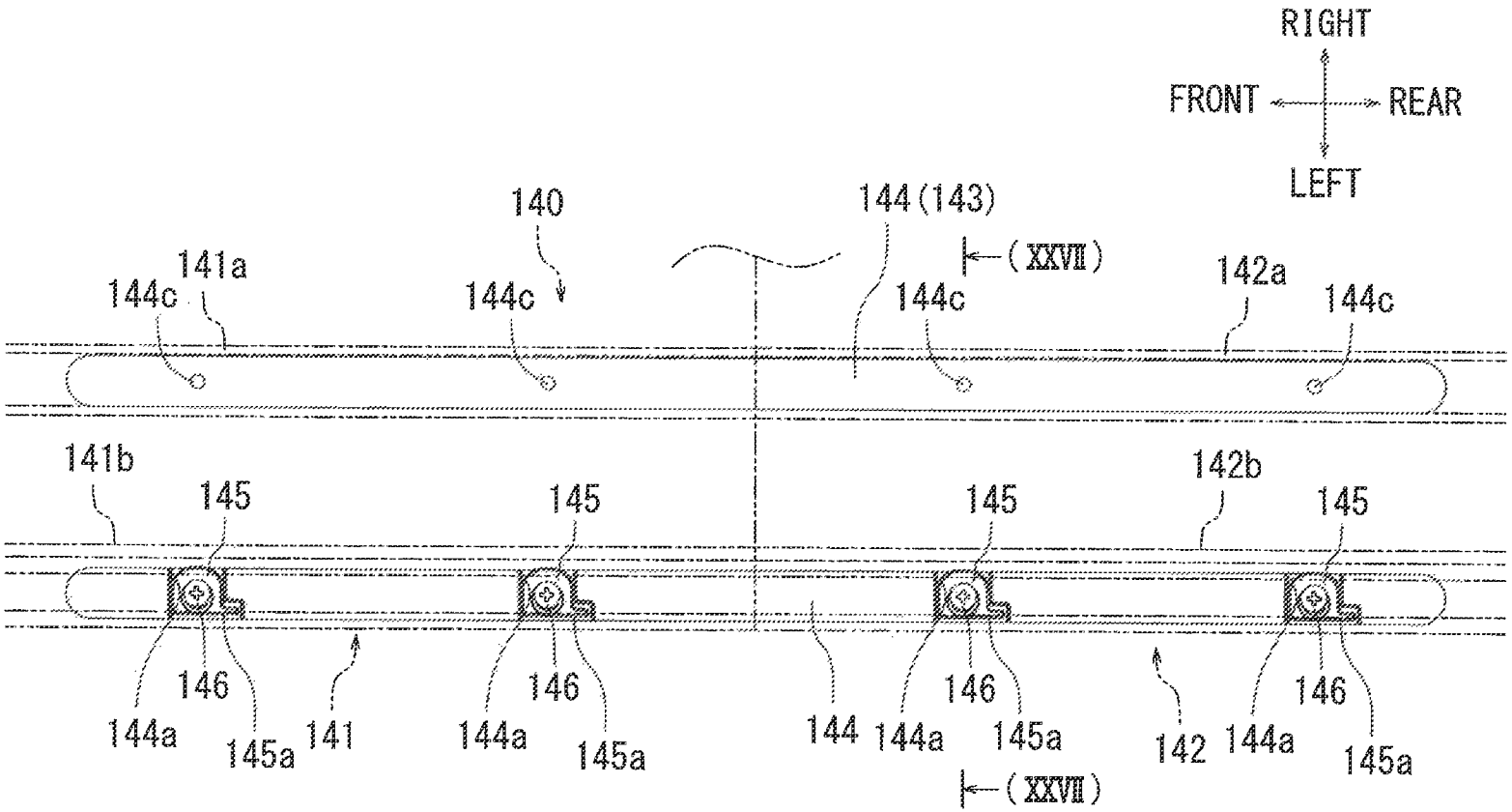
FIG. 25 is a plan view seen from an arrow (XXV) of FIG. 24, showing a connecting portion of two long rulers.
Figure 26:
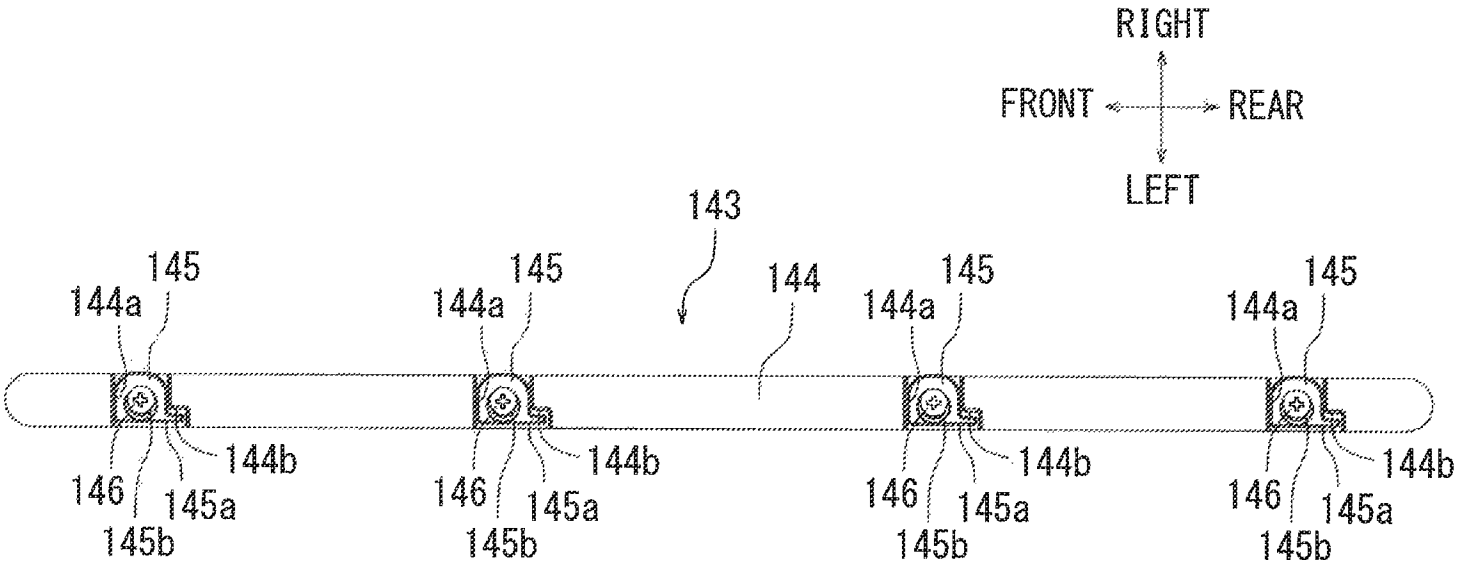
FIG. 26 is a plan view of the connecting portion.

As shown in FIG. 25, the first ruler 141 and the second ruler 142 may be joined to each other by inserting ruler connection members 143 between the first rails 141*a* and 142*a* and the second rails 141*b* and 142*b*, respectively. FIG. 26 shows the ruler connection member 143 in detail. Each of the ruler connection members 143 may have a connection main body 144 and four connection fixing members 145. Four housing recesses 144*a* may be provided at approximately equal intervals on one surface side of the connection main body 144. A positioning recess 144*b* may be provided on the rear left side of each housing recess 144*a*. Each positioning recess 144*b* may extend from the housing recess 144*a* in the rearward direction and have the same depth as that of the housing recess 144*a*.

Each of the four connection fixing members 145 may be housed in the housing recess 144*a* and fixed thereto by a fixing screw 146. A protrusion 145*a* extending in the rearward direction may be provided on the rear left side of each connection fixing member 145. Each protrusion 145*a* may be housed in the positioning recess 144*b*. All of the connection fixing members 145 may be disposed in the same direction by positioning each of the protrusions 145*a* in the corresponding positioning recess 144*b*.

As shown in FIG. 27, a flat head screw may be used as the fixing screw 146. A screw insertion hole 145*b* for inserting the fixing screw 146 may be provided in each connection fixing member 145. Four screw holes 144*c* for fastening the fixing screw 146 may be provided on the connection main body 144. The width of the connection main body 144 may be configured so as to be smaller than a length between vertical left and right walls of the first rails 141*a*, 142*a* and between vertical left and right walls of the second rails 141*b*, 142*b*. Because of this configuration, the ruler connection member 143 may be easily inserted to and retracted from the first rails 141*a*, 142*a* and the second rails 141*b*, 142*b*.

The screw insertion hole 145*b* of each connection fixing member 145 may be formed as an oblong hole shape slightly longer in the left-to-right direction than in the front-to-rear direction. Because of this configuration, each of the connection fixing members 145 may be displacably supported within the housing recess 144*a* in the left-to-right direction. Furthermore, when the fixing screw 146 is fastened to the screw hole 144*c*, a right end of the connection fixing member 145 (a side opposite to the protrusion 145*a*) may protrude from the right edge of the connection main body 144 and may be pressed by the right-side vertical wall of the first rails 141*a*, 142*a*, or the second rails 141*b*, and 142*b* due to the tapered-shaped seat surface of the screw head. In this way, the right end of the four connection fixing member 145 may be pressed to the right-side vertical wall of the rails. As a result, a left end of the connection main body 144 may be pressed by the left-side vertical wall.

The two ruler connection members 143 as discussed above may be inserted between the first rail 141*a* of the first ruler 141 and the first rail 142*a* of the second ruler 142 as well as between the second rail 141*b* of the first ruler 141 and the second rail 142*b* of the second ruler 142. As shown in FIG. 27, the two ruler connection members 143 may be inserted so as to be disposed upside down facing opposite in the up-to-down direction relative to each other. The first ruler 141 and the second ruler 142 may be joined so as to be flush with each other in the front-to-rear direction by the two ruler connection members 143 that are inserted into and fixed to the first ruler 141 and the second ruler 142. Because of this configuration, continuity of the long ruler 140 can be obtained. By utilizing the long-sized long ruler 140 in which the first ruler 141 and the second ruler 142 are joined via the ruler connection members 143, a long-sized workpiece W can be cut at a stretch. In this respect, a cutting task can be efficiently performed.

Regarding the conventional connection structures of the long ruler, German Utility Model Publication No. 202013104555 discloses that a connection member on which a plurality of magnets are attached is used for connecting two rulers due to attracting force of the magnet. Furthermore, European Patent Publication No. 1892056 discloses that a plurality of fixing screws provided on the connection member are butted against a bottom surface of the two rails in a strut manner to connect the two rails. However, according to these conventional connection structures, it may be difficult to prevent rattling or positional displacement of the rail portions with respect to the connection member in the left-to-right direction in a reliable manner. As a result, the combined two long rulers may be offset to each other in the left-right front-rear plane.

In this respect, according to the connection structure of the ruler connection members 143 in the present teaching as discussed above, each ruler connection member 143 may be fixed securely in a strut manner in the left-to-right direction within the first rails 141*a*, 142*a* and the second rails 141*b*, 142*b* such that the connection main body 144 and the connection fixing member 145 are displaced in opposite directions to be respectively pressed to the left and right vertical walls of the rails, due to the fastening force of the fixing screws 146. Because of this configuration, the ruler connection member 143 may be fixed without rattling in the left-to-right direction. As a result, the first ruler 141 and the second ruler 142 may be joined without rattling in the left-right front-rear plane. Alternatively, one of the two ruler connection members 143 may be omitted.

The present embodiment discussed above may be further modified without departing from the scope and spirit of the present teachings. In the exemplified cutting blade guide 130, the guide member 131 is configured to be held in the retraction position by the holding member 135. Instead, the holding member 135 may be omitted. In this case, the guide member 131 may be held in the retraction position by, for example, engaging the guide member 131 with a bolding protrusion or inserting/removing a holding pin through manual operation.

Furthermore, in the exemplified portable machining device 100, the machining device main body 110 may be moved in the up-to-down direction with respect to the cutting blade cover 120. Instead, the exemplified cutting blade guide 130 may be applied to the machining device in which the cutting blade cover is fixed to the machining device main body.

Furthermore, without limiting the portable machining device 100 in which a saw blade is attached as the cutting blade 111, the exemplified cutting blade guide 130 may be applied to another blade, such as a cutting device having a grooving cutter. Furthermore, in the above-discussed embodiment, the portable machining device 100 operated by the battery pack 115 is exemplified. Instead, the exemplified cutting blade guide 130 may be applied to the cutting device operated by a commercial AC power source.

What is claimed is:

1. A portable machining device, comprising:

a base with which a material to be cut is brought into contact; and a machining device main body which is supported above and movable relative to an upper surface of the base and includes a handle, a motor case and a controller housing; wherein:

the handle (a) includes (1) a front end that is integrally formed with the motor case, (2) a second end that is integrally formed with the controller housing and (3) a front grip that extends in a left-to-right direction and (b) has a loop shape between the front end and the second end; wherein:

the machining device main body (a) includes a rotary cutting blade that is rotated by using an electric motor serving as a drive source, (b) is configured to be moved in an up-to-down direction to protrude the cutting blade below a lower surface of the base such that the cutting blade cuts into the material to be cut to perform a cutting task, and (c) is supported so as to be swung in the up-to-down direction about a swing fulcrum that is disposed behind a rotation center of the cutting blade; and when the protruding length of the cutting blade protruding below the lower surface of the base is set to a maximum, (1) a controller for controlling the electric motor is tilted so as to be displaced in the upward direction as extending from the front to the rear in a side view and (2) a part of the controller is located behind the handle and the swing fulcrum in a front-to-rear direction.

2. The portable machining device according to claim 1, wherein:

a holding area for inserting a user's hand to hold the handle is arranged around the handle; and when the protruding length of the cutting blade is at the maximum, (1) a front portion of the controller is configured to overlap with the holding area in the front-to-rear direction and (2) a rear portion of the controller is configured to overlap with the holding area in the up-to-down direction.

3. The portable machining device according to claim 2, wherein:

a battery pack is attachable to the machining device main body as a power source; and when the protruding length of the cutting blade protruding below the lower surface of the base is at the maximum, the battery pack is configured to be disposed behind the electric motor in the front-to-rear direction and below the holding area of the handle in the up-to-down direction.

4. The portable machining device according to claim 1, wherein:

the machining device main body is supported so as to be tiltable with respect to the base in the left-to-right direction; and when the machining device main body is situated at a right angle, the controller is configured to be tilted so as to be displaced in a direction approaching the cutting blade as extending from the lower to the upper direction when seen from a rear view.

5. A portable machining device, comprising:

a base with which a material to be cut is brought into contact; and a machining device main body that (1) is supported above an upper surface of the base so as to be swung in an up-to-down direction about a swing fulcrum and (2) includes a handle, wherein:

the machining device main body (1) includes a rotary cutting blade that is rotated by using an electric motor serving as a drive source and (2) is configured to be moved in the up-to-down direction to protrude the catting blade below a lower surface of the base such that the cutting blade cuts into the material to be cut to perform a cutting task;

the swing fulcrum is disposed behind a rotation center of the cutting blade;

a controller for controlling the electric motor that is disposed such that at least a part of the controller is on an opposite side of the swing fulcrum with from the electric motor in a front-to-rear direction; and when the protruding length of the cutting blade protruding below the lower surface of the base is at a maximum, (1) the controller is tilted so as to be displaced in the upward direction and extending from the front to the rear in a side view and (2) a part of the controller is located behind the handle and the swing fulcrum in a front-to-rear direction.

6. A portable machining device, comprising:

a base with a rectangular flat plate shape where the lower underside surface of the base is brought into contact with a material to be cut;

a machining device main body that is supported above and movable relative to an upper surface of the base; and a handle that is integrally formed with the machining device main body, and is surrounded by a holding area where a user may grasp the handle, wherein:

the machining device main body (a) includes a rotary cutting blade that is rotated by using an electric motor serving as a drive source, wherein the motor has a surrounding motor case with intake holes, (b) is configured to be moved in an up-to-down direction to protrude the cutting blade below a lower surface of the base such that the cutting blade cuts into the material to be cut to perform a cutting task, wherein the cutting blade is covered by a cutting blade cover such that its upper periphery is enclosed by the cutting blade cover, which is supported on upper surface side of the base;

the machining device main body is supported so as to be swung in the up-to-down direction about a swing fulcrum that is disposed behind a rotation center of the cutting blade;

the machining device main body is biased to swing in an upwards direction by a compression spring interposed between the machining device main body and the base in the up-to-down direction, where said spring is at the center of the base in a front-to-rear direction;

when a protruding length of the cutting blade protruding below the lower surface of the base is set to a maximum, a part of a controller for controlling the electric motor is configured to be located behind the handle in the front-to-rear direction, where the controller has a rectangular shape and is tilted so as to be displaced in the upward direction as extending from the front to the rear in a side view; and a part of the controller is located behind the swing fulcrum in the front-to-rear direction.

7. The portable machining device of claim 6, wherein the device further includes a front support portion and a rear support portion displaced on the upper surface of the base at the front and rear ends, respectively, wherein the cutting blade cover is supported so as to be tilted in a left-to-right direction via the front support portion and rear support portion, wherein the blade within the cutting blade cover is also tilted in the left-to-right direction by the same amount and can perform an oblique cut into a workpiece.

8. The portable machining device of claim 7, wherein an angle scale is provided on the upper surface of the base to visually aid the user in tilting the cutting blade cover in the left-to-right direction, where degrees are demarcated by lines.

9. The portable machining device of claim 8, wherein a tilt position of the cutting blade cover and the cutting blade may be -fastened to a particular angle by fastening a fixing screw.

10. The portable machining device of claim 6, wherein the cutting blade cover covers and encloses an upper periphery of the cutting blade, wherein a portion of the blade protrudes below the cutting blade cover in a downward direction below the bottom surface of the base, wherein the cutting blade may be moved in the up-to-down direction within the cutting blade cover in accordance with an up-to-down movement of the machining device body relative to the cutting blade cover.

11. The portable machining device according to claim 6, wherein the controller includes a controller circuit board with mounted components.

12. The portable machining device according to claim 11, wherein a cooling fan is attached to the motor shaft driving the electric motor, and a ventilation hole is present in between the motor case and the controller in the front-to-rear and left-to-right directions, such that by operation of the motor and cooling fan air is drawn into the device through the intake holes of the motor case and has a structural flow path where it first cools the motor, then flows through the ventilation hole, then cools the controller including the controller circuit board and associated mounted components, and then finally may leave the device through an exhaust hole.

13. The portable machining device according to claim 6, wherein when the protruding length of the cutting blade protruding below the lower surface of the base is at a maximum, (1) a front portion of the controller is configured to be overlapped with the holding area in the front-to-rear directions and (2) a rear portion of the controller is configured to be overlapped with the holding area in the up-to-down direction.

14. The portable machining device according to claim 6, wherein:

a battery pack is attachable to the machining device main body as its sole power source; and when the protruding length of the cutting blade protruding below the lower surface of the base is at the maximum, the battery pack is configured to be disposed behind the electric motor in the front-to-rear direction and below the holding area of the handle in the up-to-down direction.

* * * * *